US010164374B1

(12) United States Patent
Reed

(10) Patent No.: US 10,164,374 B1
(45) Date of Patent: Dec. 25, 2018

(54) RECEPTACLE SOCKETS FOR TWIST-LOCK CONNECTORS

(71) Applicant: Express Imaging Systems, LLC, Renton, WA (US)

(72) Inventor: William G. Reed, Seattle, WA (US)

(73) Assignee: Express Imaging Systems, LLC, Renton, WA (US)

( * ) Notice: Subject to any disclaimer, the term of this patent is extended or adjusted under 35 U.S.C. 154(b) by 0 days.

(21) Appl. No.: 15/799,744

(22) Filed: Oct. 31, 2017

(51) Int. Cl.

| | |
|---|---|
| ***H01R 43/26*** | (2006.01) |
| ***H01R 13/625*** | (2006.01) |
| ***H01R 13/639*** | (2006.01) |
| ***H01R 43/20*** | (2006.01) |
| ***H01R 13/66*** | (2006.01) |

(52) U.S. Cl.
CPC ..... *H01R 13/625* (2013.01); *H01R 13/639* (2013.01); *H01R 13/6608* (2013.01); *H01R 43/205* (2013.01); *H01R 43/26* (2013.01)

(58) Field of Classification Search
None
See application file for complete search history.

(56) References Cited

U.S. PATENT DOCUMENTS

| | | | |
|---|---|---|---|
| 4,153,927 | A | 5/1979 | Owens |
| 4,237,377 | A | 12/1980 | Sansum |
| 4,811,176 | A | 3/1989 | Myhres |
| 5,086,379 | A | 2/1992 | Denison et al. |
| 5,150,009 | A | 9/1992 | Kling et al. |
| 5,160,202 | A | 11/1992 | Légaré |
| 5,230,556 | A | 7/1993 | Canty et al. |
| 5,274,350 | A | 12/1993 | Larson |
| 5,349,505 | A | 9/1994 | Poppenheimer |

(Continued)

FOREIGN PATENT DOCUMENTS

| | | |
|---|---|---|
| DE | 40 01 980 A1 | 8/1990 |
| DE | 198 10 827 A1 | 9/1999 |

(Continued)

OTHER PUBLICATIONS

Amendment, filed Jan. 8, 2018, for U.S. Appl. No. 14/488,069, Renn et al., "Solid-State Lighting Devices and Systems," 15 pages.

(Continued)

*Primary Examiner* — Truc Nguyen
(74) *Attorney, Agent, or Firm* — Cozen O'Connor

(57) ABSTRACT

A twist-lock connector that includes a printed circuit board component with one or more flexible portions is disclosed. The flexible portions may be formed within an interior portion of the printed circuit board by routing or otherwise removing a portion of the printed circuit board to create one or a plurality of side for each flexible portion. One or more electrical contacts may be positioned on each flexible portion and arranged to be electrically coupled with male electrical contacts that are part of a corresponding twist-lock plug, thereby deflecting the flexible portions. When deflected, the flexible portions exert an opposing, biasing force in the direction of the male electrical contacts to maintain contact there between. One or more of a mounting base and a support base may be clamped to either or both sides of the printed circuit board to provide further stability for the flexible portions.

32 Claims, 7 Drawing Sheets

(56) References Cited

U.S. PATENT DOCUMENTS 5,450,302 A 9/1995 Maase et al.
5,948,829 A 9/1999 Wallajapet et al.
6,094,919 A 8/2000 Bhatia
6,111,739 A 8/2000 Wu et al.
6,149,283 A 11/2000 Conway et al.
6,230,497 B1 5/2001 Morris et al.
D447,266 S 8/2001 Verfuerth
6,400,101 B1 6/2002 Biebl et al.
D460,735 S 7/2002 Verfuerth
D463,059 S 9/2002 Verfuerth
6,499,860 B2 12/2002 Begemann
6,517,359 B1 * 2/2003 Felps ..... H01R 13/2421 439/246
6,585,396 B1 7/2003 Verfuerth
6,601,972 B2 8/2003 Sei et al.
D479,826 S 9/2003 Verfuerth et al.
6,612,720 B1 9/2003 Beadle
D483,332 S 12/2003 Verfuerth
6,753,842 B1 6/2004 Williams et al.
6,758,580 B1 7/2004 Verfuerth
6,787,999 B2 9/2004 Stimac et al.
6,847,156 B2 1/2005 Kim
6,880,956 B2 4/2005 Zhang
6,885,134 B2 4/2005 Kurashima et al.
6,902,292 B2 6/2005 Lai
6,948,829 B2 9/2005 Verdes et al.
6,964,501 B2 11/2005 Ryan
6,964,502 B1 11/2005 Verfuerth
7,066,622 B2 6/2006 Alessio
7,111,961 B2 9/2006 Trenchard et al.
7,144,140 B2 12/2006 Sun et al.
7,145,179 B2 12/2006 Petroski
7,165,866 B2 1/2007 Li
D538,462 S 3/2007 Verfuerth et al.
7,188,967 B2 3/2007 Dalton et al.
7,196,477 B2 3/2007 Richmond
7,213,940 B1 5/2007 Van De Ven et al.
7,218,056 B1 5/2007 Harwood
7,239,087 B2 7/2007 Ball
7,252,385 B2 8/2007 Engle et al.
7,258,464 B2 8/2007 Morris et al.
7,270,441 B2 9/2007 Fiene
7,281,820 B2 10/2007 Bayat et al.
D557,817 S 12/2007 Verfuerth
D560,469 S 1/2008 Bartol et al.
7,314,261 B2 1/2008 Jackson Pulver et al.
7,314,291 B2 1/2008 Tain et al.
7,317,403 B2 1/2008 Grootes et al.
7,322,714 B2 1/2008 Barnett et al.
7,330,002 B2 2/2008 Joung
7,339,323 B2 3/2008 Bucur
7,341,362 B2 3/2008 Bjornson et al.
7,387,403 B2 6/2008 Mighetto
7,401,942 B1 7/2008 Verfuerth et al.
7,438,440 B2 10/2008 Dorogi
7,440,280 B2 10/2008 Shuy
7,458,330 B2 12/2008 MacDonald et al.
7,461,964 B1 12/2008 Aubrey
7,475,002 B1 1/2009 Mann
7,524,089 B2 4/2009 Park
7,538,499 B2 5/2009 Ashdown
7,549,773 B2 6/2009 Lim
D595,894 S 7/2009 Verfuerth et al.
7,556,406 B2 7/2009 Petroski et al.
7,559,674 B2 7/2009 He et al.
7,563,006 B1 7/2009 Verfuerth et al.
7,575,338 B1 8/2009 Verfuerth
7,578,596 B2 8/2009 Martin
7,578,597 B2 8/2009 Hoover et al.
7,581,856 B2 9/2009 Kang et al.
7,595,595 B2 9/2009 Mehta
D606,697 S 12/2009 Verfuerth et al.
D606,698 S 12/2009 Verfuerth et al.
7,626,342 B2 12/2009 Sun et al.
7,628,506 B2 12/2009 Verfuerth et al.
7,633,463 B2 12/2009 Negru
7,635,203 B2 12/2009 Weaver, Jr. et al.
7,637,633 B2 12/2009 Wong
7,654,699 B2 2/2010 Chang et al.
7,665,862 B2 2/2010 Villard
7,686,461 B2 3/2010 Goray et al.
7,695,160 B2 4/2010 Hirata et al.
7,697,925 B1 4/2010 Wilson et al.
7,703,951 B2 4/2010 Piepgras et al.
D617,028 S 6/2010 Verfuerth et al.
D617,029 S 6/2010 Verfuerth et al.
7,748,879 B2 7/2010 Koike et al.
7,762,861 B2 7/2010 Verfuerth et al.
7,766,507 B2 8/2010 Nakajima
7,766,508 B2 8/2010 Villard et al.
7,780,310 B2 8/2010 Verfuerth et al.
7,780,314 B2 8/2010 Seabrook
D623,340 S 9/2010 Verfuerth et al.
7,857,497 B2 12/2010 Koike et al.
7,874,699 B2 1/2011 Liang
7,874,710 B2 1/2011 Tsai
D632,006 S 2/2011 Verfuerth et al.
7,901,107 B2 3/2011 Van De Ven et al.
7,932,535 B2 4/2011 Mahalingam et al.
7,960,919 B2 6/2011 Furukawa
7,976,182 B2 7/2011 Ribarich
7,985,005 B2 7/2011 Alexander et al.
8,018,135 B2 9/2011 Van De Ven et al.
8,057,070 B2 11/2011 Negley et al.
8,066,410 B2 11/2011 Booth et al.
D650,225 S 12/2011 Bartol et al.
8,070,312 B2 12/2011 Verfuerth et al.
8,100,552 B2 1/2012 Spero
8,118,450 B2 2/2012 Villard
8,118,456 B2 2/2012 Reed et al.
8,136,958 B2 3/2012 Verfuerth et al.
8,143,769 B2 3/2012 Li
8,186,855 B2 5/2012 Wassel et al.
RE43,456 E 6/2012 Verfuerth et al.
8,254,137 B2 8/2012 Wilkolaski et al.
8,260,575 B2 9/2012 Walters et al.
8,324,641 B2 12/2012 Yan et al.
8,324,840 B2 12/2012 Shteynberg et al.
8,334,640 B2 12/2012 Reed et al.
8,337,043 B2 12/2012 Verfuerth et al.
8,362,677 B1 1/2013 Morejon et al.
8,376,583 B2 2/2013 Wang et al.
8,378,563 B2 2/2013 Reed et al.
8,408,739 B2 4/2013 Villard et al.
8,427,076 B2 4/2013 Bourquin et al.
8,436,556 B2 5/2013 Eisele et al.
8,547,022 B2 10/2013 Summerford et al.
8,637,877 B2 1/2014 Negley
8,646,944 B2 2/2014 Villard
8,674,608 B2 3/2014 Holland et al.
8,794,804 B2 8/2014 Verfuerth et al.
8,816,576 B1 8/2014 Erion et al.
8,827,512 B1 9/2014 Beadle
8,858,019 B2 10/2014 Novak et al.
8,872,964 B2 10/2014 Reed et al.
8,926,138 B2 1/2015 Reed et al.
8,926,139 B2 1/2015 Reed et al.
8,988,005 B2 3/2015 Jungwirth et al.
9,107,026 B1 8/2015 Viswanadham et al.
9,312,451 B2 4/2016 Reed et al.
9,357,618 B2 5/2016 Pandharipande et al.
9,572,230 B2 2/2017 Reed
9,657,922 B2 5/2017 Negley et al.
2002/0018344 A1 * 2/2002 Sears, Jr. ..... H01R 29/00 362/265
2003/0123521 A1 7/2003 Luoma
2004/0120156 A1 6/2004 Ryan
2005/0057187 A1 3/2005 Catalano
2005/0146884 A1 7/2005 Scheithauer
2005/0231133 A1 10/2005 Lys
2005/0265019 A1 12/2005 Sommers et al.
2006/0098440 A1 5/2006 Allen
2007/0102033 A1 5/2007 Petrocy
2007/0139961 A1 6/2007 Cheah et al.

(56) References Cited

U.S. PATENT DOCUMENTS

| | | | | |
|---|---|---|---|---|
| 2007/0147046 | A1 | 6/2007 | Arik et al. | |
| 2007/0153550 | A1 | 7/2007 | Lehman et al. | |
| 2007/0183156 | A1 | 8/2007 | Shan | |
| 2007/0285000 | A1 | 12/2007 | Lim et al. | |
| 2007/0297184 | A1 | 12/2007 | Isely | |
| 2008/0106907 | A1 | 5/2008 | Trott et al. | |
| 2008/0130304 | A1 | 6/2008 | Rash et al. | |
| 2008/0205068 | A1 | 8/2008 | Neeld et al. | |
| 2008/0232116 | A1 | 9/2008 | Kim | |
| 2008/0266839 | A1 | 10/2008 | Claypool et al. | |
| 2008/0298058 | A1 | 12/2008 | Kan et al. | |
| 2009/0000217 | A1 | 1/2009 | Verfuerth et al. | |
| 2009/0001372 | A1 | 1/2009 | Arik et al. | |
| 2009/0161356 | A1 | 6/2009 | Negley et al. | |
| 2009/0225540 | A1 | 9/2009 | Chen | |
| 2009/0244899 | A1 | 10/2009 | Chyn | |
| 2009/0278479 | A1 | 11/2009 | Platner et al. | |
| 2010/0008090 | A1 | 1/2010 | Li et al. | |
| 2010/0053962 | A1 | 3/2010 | Mo et al. | |
| 2010/0084979 | A1 | 4/2010 | Burton et al. | |
| 2010/0093205 | A1* | 4/2010 | Stone | H01R 13/5219 439/352 |
| 2010/0123403 | A1 | 5/2010 | Reed | |
| 2010/0149822 | A1 | 6/2010 | Cogliano et al. | |
| 2010/0177519 | A1 | 7/2010 | Schlitz | |
| 2010/0246168 | A1 | 9/2010 | Verfuerth et al. | |
| 2010/0277914 | A1 | 11/2010 | Bachl et al. | |
| 2010/0277917 | A1 | 11/2010 | Shan | |
| 2010/0290236 | A1 | 11/2010 | Gingrich, III et al. | |
| 2010/0328947 | A1 | 12/2010 | Chang et al. | |
| 2011/0001626 | A1 | 1/2011 | Yip et al. | |
| 2011/0026264 | A1 | 2/2011 | Reed et al. | |
| 2011/0090686 | A1 | 4/2011 | Pickard | |
| 2011/0176297 | A1 | 7/2011 | Hsia et al. | |
| 2011/0235317 | A1 | 9/2011 | Verfuerth et al. | |
| 2011/0282468 | A1 | 11/2011 | Ashdown | |
| 2011/0310605 | A1 | 12/2011 | Renn et al. | |
| 2012/0081906 | A1 | 4/2012 | Verfuerth et al. | |
| 2012/0224363 | A1 | 9/2012 | Van De Ven | |
| 2012/0286770 | A1 | 11/2012 | Schröder et al. | |
| 2013/0029510 | A1* | 1/2013 | Bayliss | H01R 13/625 439/310 |
| 2013/0057158 | A1 | 3/2013 | Josefowicz et al. | |
| 2013/0308325 | A1 | 11/2013 | Verfuerth et al. | |
| 2014/0028200 | A1 | 1/2014 | Van Wagoner et al. | |
| 2014/0140052 | A1 | 5/2014 | Villard | |
| 2014/0313719 | A1 | 10/2014 | Wang et al. | |
| 2014/0339390 | A1 | 11/2014 | Verfuerth et al. | |
| 2014/0359078 | A1 | 12/2014 | Liu | |
| 2015/0028770 | A1 | 1/2015 | Verfuerth et al. | |
| 2015/0069920 | A1 | 3/2015 | Denteneer et al. | |
| 2015/0078005 | A1 | 3/2015 | Renn et al. | |
| 2015/0123563 | A1 | 5/2015 | Dahlen | |
| 2015/0340805 | A1* | 11/2015 | Jordan | H01R 13/629 439/338 |
| 2016/0156115 | A1* | 6/2016 | Feye-Hohmann | H01R 12/58 439/84 |
| 2016/0234899 | A1 | 8/2016 | Reed et al. | |
| 2017/0172652 | A1* | 6/2017 | Govari | H01R 24/58 |
| 2017/0279230 | A1* | 9/2017 | Komoto | H01R 13/73 |

FOREIGN PATENT DOCUMENTS

| | | | |
|---|---|---|---|
| EP | 1 734 795 | A1 | 12/2006 |
| EP | 2 320 713 | A2 | 5/2011 |
| EP | 2 629 491 | A1 | 8/2013 |
| FR | 2 883 306 | A1 | 9/2006 |
| JP | 2001-333420 | A | 11/2001 |
| JP | 2004-349065 | A | 12/2004 |
| JP | 2005-93171 | A | 4/2005 |
| JP | 2006-031977 | A | 2/2006 |
| JP | 2006-244711 | A | 9/2006 |
| KR | 10-2008-0094344 | A | 10/2008 |
| KR | 10-2012-0108662 | A | 10/2012 |
| WO | 02/076068 | A1 | 9/2002 |
| WO | 03/056882 | A1 | 7/2003 |
| WO | 2006/057866 | A2 | 6/2006 |
| WO | 2007/036873 | A2 | 4/2007 |
| WO | 2008/030450 | A2 | 3/2008 |
| WO | 2009/040703 | A2 | 4/2009 |
| WO | 2009/105168 | A2 | 8/2009 |
| WO | 2011/005441 | A2 | 1/2011 |
| WO | 2011/019806 | A2 | 2/2011 |
| WO | 2012/033750 | A1 | 3/2012 |
| WO | 2015/039120 | A1 | 3/2015 |

OTHER PUBLICATIONS

Advisory Action, dated Jan. 30, 2018, for U.S. Appl. No. 14/488,069, Renn et al., "Solid-State Lighting Devices and Systems," 7 pages.

Amendment, filed Feb. 1, 2018, for U.S. Appl. No. 14/488,069, Renn et al., "Solid-State Lighting Devices and Systems," 15 pages.

Office Action, dated Mar. 28, 2018, for U.S. Appl. No. 14/488,069, Renn et al., "Solid-State Lighting Devices and Systems," 22 pages.

"A Review of the Literature on Light Flicker: Ergonomics, Biological Attributes, Potential Health Effects, and Methods in Which Some LED Lighting May Introduce Flicker," IEEE Standard P1789, Feb. 26, 2010, 26 pages.

Amendment, filed Sep. 6, 2017, for U.S. Appl. No. 14/488,069, Renn et al., "Solid-State Lighting Devices and Systems," 6 pages.

Extended European Search Report dated Aug. 25, 2016, for corresponding EP Application No. 14843796.5-1757, 6 pages.

Final Office Action, dated Nov. 7, 2017, for U.S. Appl. No. 14/488,069, Renn et al., "Solid-State Lighting Devices and Systems," 19 pages.

International Preliminary Report on Patentability, dated Mar. 22, 2016, for International Application No. PCT/US2014/055909, 14 pages.

International Search Report and Written Opinion, dated Feb. 29, 2015, for PCT/US2015/053000, 20 pages.

International Search Report and Written Opinion, dated Feb. 29, 2015, for PCT/US2015/053006, 21 pages.

International Search Report and Written Opinion, dated Jan. 13, 2016. for PCT/US2015/053009, 15 pages.

International Search Report, dated Dec. 13, 2010 for PCT/US2010/035649, 3 pages.

International Search Report, dated Dec. 15, 2010 for PCT/US2010/035658, 3 pages.

International Search Report, dated Dec. 28, 2010 for PCT/US2010/035651, 3 pages.

International Search Report, dated Dec. 30, 2014, for PCT/US2014/055909, 3 pages.

International Search Report, dated Jul. 9, 2009 for PCT/US2009/043171, 5 pages.

International Search Report, dated Jun. 10, 2009, for PCT/US2009/043170, 4 pages.

International Search Report, dated Jun. 21, 2010, for PCT/US2009/064625, 3 pages.

International Search Report, dated Nov. 29, 2010, for PCT/US2010/033000, 3 pages.

International Search Report, dated Oct. 8, 2012 for PCT/US2012/033059, 3 pages.

International Search Report, dated Sep. 29, 2011, for PCT/US2011/041402, 3 pages.

Koninklijke Philips N.V., "High Intensity Discharge Lamps: MasterColor Ceramic Metal Halide Lamps," Lighting Catalog, Lamp Specification Guide, p. 70, 2013.

Notice of Allowance dated Oct. 5, 2016 for U.S. Appl. No. 14/869,511, Reed, "Centralized Control of Area Lighting Hours of Illumination," 8 pages.

Office Action dated Aug. 31, 2016, for U.S. Appl. No. 14/869,501,Reed, "Asset Management System for Outdoor Luminaires," 15 pages.

Office Action dated Feb. 17, 2017, for U.S. Appl. No. 14/939,856, Reed et al., "Luminaire With Adjustable Illumination Pattern," 13 pages.

Office Action, dated Jun. 7, 2017, for U.S. Appl. No. 14/488,069, Renn et al., "Solid-State Lighting Devices and Systems," 20 pages.

(56) References Cited

OTHER PUBLICATIONS

Reed et al., "Apparatus and Method for Schedule Based Operation of a Luminaire" Amendment filed Dec. 7, 2016, for U.S. Appl. No. 14/552,274, 11 pages.
Reed et al., "Electrically Isolated Heat Sink for Solid-State Light," U.S. Appl. No. 61/229,435, filed Jul. 29, 2009, 29 pages.
Reed et al., "Gas-Discharge Lamp Replacement With Passive Cooling,"U.S. Appl. No. 61/174,913, filed May 1, 2009, 29 pages.
Reed et al., "Gas-Discharge Lamp Replacement," U.S. Appl. No. 61/052,924, filed May 13, 2008, 32 pages.
Reed et al., "Long-Range Motion Detection for Illumination Control," U.S. Appl. No. 61/180,017, filed May 20, 2009, 32 pages.
Reed et al., "Low-Profile Pathway Illumination System," U.S. Appl. No. 61/051,619, filed May 8, 2008, 25 pages.
Reed et al., "Turbulent Flow Cooling for Electronic Ballast," U.S. Appl. No. 61/088,651, filed Aug. 13, 2008, 23 pages.
Reed et al., "Electrically Isolated Heat Sink for Solid-State Light," Amendment filed Jan. 14, 2013, for U.S. Appl. No. 12/846,516, 16 pages.
Reed et al., "Electrically Isolated Heat Sink for Solid-State Light," Office Action dated Apr. 4, 2013, for U.S. Appl. No. 12/846,516, 12 pages.
Reed et al., "Electrically Isolated Heat Sink for Solid-State Light," Office Action dated Oct. 12, 2012, for U.S. Appl. No. 12/846,516, 11 pages.
Reed et al., "Gas-Discharge Lamp Replacement With Passive Cooling," Amendment filed Apr. 11, 2014, for U.S. Appl. No. 12/769,956, 16 pages.
Reed et al., "Gas-Discharge Lamp Replacement With Passive Cooling," Amendment filed Aug. 11, 2014, for U.S. Appl. No. 12/769,956, 15 pages.
Reed et al., "Gas-Discharge Lamp Replacement With Passive Cooling," Amendment filed Jul. 25, 2013, for U.S. Appl. No. 12/769,956, 12 pages.
Reed et al., "Gas-Discharge Lamp Replacement With Passive Cooling," Amendment filed Mar. 25, 2013, for U.S. Appl. No. 12/769,956, 13 pages.
Reed et al., "Gas-Discharge Lamp Replacement With Passive Cooling," Amendment filed Nov. 27, 2013, for U.S. Appl. No. 12/769,956, 19 pages.
Reed et al., "Gas-Discharge Lamp Replacement With Passive Cooling," Amendment filed Oct. 30, 2012, for U.S. Appl. No. 12/769,956, 12 pages.
Reed et al., "Gas-Discharge Lamp Replacement With Passive Cooling," Notice of Allowance dated Aug. 29, 2014, for U.S. Appl. No. 12/769,956, 12 pages.
Reed et al., "Gas-Discharge Lamp Replacement With Passive Cooling," Office Action dated Apr. 26, 2013, for U.S. Appl. No. 12/769,956, 20 pages.
Reed et al., "Gas-Discharge Lamp Replacement With Passive Cooling," Office Action dated Aug. 28, 2013, for U.S. Appl. No. 12/769,956, 22 pages.
Reed et al., "Gas-Discharge Lamp Replacement With Passive Cooling," Office Action dated Dec. 23, 2013, for U.S. Appl. No. 12/769,956, 18 pages.
Reed et al., "Gas-Discharge Lamp Replacement With Passive Cooling," Office Action dated Jul. 31, 2012, for U.S. Appl. No. 12/769,956, 15 pages.
Reed et al., "Gas-Discharge Lamp Replacement With Passive Cooling," Office Action dated May 9, 2014, for U.S. Appl. No. 12/769,956, 22 pages.
Reed et al., "Gas-Discharge Lamp Replacement With Passive Cooling," Office Action dated Nov. 26, 2012, for U.S. Appl. No. 12/769,956, 18 pages.
Reed et al., "Gas-Discharge Lamp Replacement," Amendment filed Apr. 10, 2012, for U.S. Appl. No. 12/437,467, 22 pages.
Reed et al., "Gas-Discharge Lamp Replacement," Amendment filed Jul. 30, 2014, for U.S. Appl. No. 12/437,467, 14 pages.
Reed et al., "Gas-Discharge Lamp Replacement," Amendment filed Sep. 26, 2013, for U.S. Appl. No. 12/437,467, 20 pages.
Reed et al., "Gas-Discharge Lamp Replacement," Amendment filed Sep. 6, 2011, for U.S. Appl. No. 12/437,467, 14 pages.
Reed et al., "Gas-Discharge Lamp Replacement," Amendment filed Sep. 7, 2012, for U.S. Appl. No. 12/437,467, 9 pages.
Reed et al., "Gas-Discharge Lamp Replacement," Notice of Allowance dated Sep. 3, 2014, for U.S. Appl. No. 12/437,467, 8 pages.
Reed et al., "Gas-Discharge Lamp Replacement," Office Action dated Jan. 17, 2013, for U.S. Appl. No. 12/437,467, 12 pages.
Reed et al., "Gas-Discharge Lamp Replacement," Office Action dated Jan. 30, 2014, for U.S. Appl. No. 12/437,467, 17 pages.
Reed et al., "Gas-Discharge Lamp Replacement," Office Action dated Jun. 12, 2012, for U.S. Appl. No. 12/437,467, 17 pages.
Reed et al., "Gas-Discharge Lamp Replacement," Office Action dated Jun. 22, 2011, for U.S. Appl. No. 12/437,467, 12 pages.
Reed et al., "Gas-Discharge Lamp Replacement," Office Action dated Jun. 26, 2013, for U.S. Appl. No. 12/437,467, 15 pages.
Reed et al., "Gas-Discharge Lamp Replacement," Office Action dated Nov. 17, 2011, for U.S. Appl. No. 12/437,467, 15 pages.
Reed et al., "Turbulent Flow Cooling for Electronic Ballast," Amendment filed Apr. 29, 2011, for U.S. Appl. No. 12/540,250, 11 pages.
Reed et al., "Turbulent Flow Cooling for Electronic Ballast," Amendment filed Apr. 5, 2012, for U.S. Appl. No. 12/540,250, 8 pages.
Reed et al., "Turbulent Flow Cooling for Electronic Ballast," Amendment filed Oct. 14, 2011, for U.S. Appl. No. 12/540,250, 12 pages.
Reed et al., "Turbulent Flow Cooling for Electronic Ballast," Notice of Allowance dated Aug. 15, 2012, for U.S. Appl. No. 12/540,250, 7 pages.
Reed et al., "Turbulent Flow Cooling for Electronic Ballast," Office Action dated Dec. 29, 2010, for U.S. Appl. No. 12/540,250, 16 pages.
Reed et al., "Turbulent Flow Cooling for Electronic Ballast," Office Action dated Jan. 5, 2012, for U.S. Appl. No. 12/540,250, 12 pages.
Reed et al., "Turbulent Flow Cooling for Electronic Ballast," Office Action dated Jul. 20, 2011, for U.S. Appl. No. 12/540,250, 15 pages.
Reed, "Apparatus and Method of Energy Efficient Illumination," U.S. Appl. No. 61/346,263, filed May 19, 2010, 67 pages.
Reed, "Apparatus and Method of Energy Efficient Illumination," U.S. Appl. No. 61/333,983, filed May 12, 2010, 57 pages.
Reed, "Asset Management System for Outdoor Luminaires," U.S. Appl. No. 62/082,463, filed Nov. 20, 2014, 56 pages.
Reed, "Centralized Control Area Lighting Hours of Illumination," U.S. Appl. No. 62/057,419, filed Sep. 30, 2014, 39 pages.
Reed, "Centralized Control of Area Lighting Hours of Illumination," Office Action dated Mar. 24, 2016 for U.S. Appl. No. 14/869,511, 31 pages.
Reed, "Detection and Correction of Faulty Photo Controls in Outdoor Luminaires," Notice of Allowance dated May 19, 2016 for U.S. Appl. No. 14/869,492, 9 pages.
Reed, "Detection and Correction of Faulty Photo Controls in Outdoor Luminaires," U.S. Appl. No. 62/068,517, filed Oct. 24, 2014, 47 pages.
Reed, "Detection and Correction of Faulty Photo Controls in Outdoor Luminaires," U.S. Appl. No. 62/183,505, filed Jun. 23, 2015, 71 pages.
Reed, "Electronic Control to Regulate Power for Solid-State Lighting and Methods Thereof," U.S. Appl. No. 61/115,438, filed Nov. 17, 2008, 51 pages.
Reed, "Electronic Control to Regulate Power for Solid-State Lighting and Methods Thereof," U.S. Appl. No. 61/154,619, filed Feb. 23, 2009, 62 pages.
Reed, "High Reliability Photocontrol Controls With 0 to 10 Volt Dimming Signal Line and Method," U.S. Appl. No. 62/507,730, filed May 17, 2017, 17 pages.
Reed, "Luminaire With Adjustable Illumination Pattern," U.S. Appl. No. 62/114,826, filed Feb. 11, 2015, 68 pages.
Renn et al., "Solid State Lighting Device and Method Employing Heat Exchanger Thermally Coupled Circuit Board," Notice of Allowance dated Sep. 10, 2015, for U.S. Appl. No. 13/166,626, 8 pages.

(56) References Cited

OTHER PUBLICATIONS

Renn et al., "Solid State Lighting Device and Method Employing Heat Exchanger Thermally Coupled Circuit Board," Office Action dated Apr. 30, 2015, for U.S. Appl. No. 13/166,626, 17 pages.
Renn et al., "Solid State Lighting Device and Method Employing Heat Exchanger Thermally Coupled Circuit Board," U.S. Appl. No. 61/357,421, filed Jun. 22, 2010, 49 pages.
Renn et al., "Solid-State Lighting Devices and Systems," Amendment filed Apr. 20, 2017 for U.S. Appl. No. 14/488,069, 14 pages.
Renn et al., "Solid-State Lighting Devices and Systems," Amendment filed Nov. 17, 2016 for U.S. Appl. No. 14/488,069, 4 pages.
Renn et al., "Solid-State Lighting Devices and Systems," Office Action dated Aug. 17, 2016 for U.S. Appl. No. 14/488,069, 9 pages.
Renn et al., "Solid-State Lighting Devices and Systems," Office Action dated Dec. 19, 2016 for U.S. Appl. No. 14/488,069, 10 pages.
Renn et al., "Solid-State Lighting Devices and Systems," U.S. Appl. No. 61/878,425, filed Sep. 16, 2013, 32 pages.
Renn et al., "Solid State Lighting Device and Method Employing Heat Exchanger Thermally Coupled Circuit Board," Amendment filed Dec. 29, 2014, for U.S. Appl. No. 13/166,626, 23 pages.
Renn et al., "Solid State Lighting Device and Method Employing Heat Exchanger Thermally Coupled Circuit Board," Amendment filed Mar. 11, 2014, for U.S. Appl. No. 13/166,626, 24 pages.
Renn et al., "Solid State Lighting Device and Method Employing Heat Exchanger Thermally Coupled Circuit Board," Amendment filed Sep. 24, 2013 for U.S. Appl. No. 13/166,626, 19 pages.
Renn et al., "Solid State Lighting Device and Method Employing Heat Exchanger Thermally Coupled Circuit Board," Office Action dated Apr. 29, 2013, for U.S. Appl. No. 13/166,626, 19 pages.
Renn et al., "Solid State Lighting Device and Method Employing Heat Exchanger Thermally Coupled Circuit Board," Office Action dated Jan. 14, 2014, for U.S. Appl. No. 13/166,626, 19 pages.
Renn et al., "Solid State Lighting Device and Method Employing Heat Exchanger Thermally Coupled Circuit Board," Office Action dated Oct. 2, 2014, for U.S. Appl. No. 13/166,626, 18 pages.
Written Opinion, dated Dec. 13, 2010 for PCT/US2010/035649, 4 pages.
Written Opinion, dated Dec. 15, 2010 for PCT/US2010/035658, 3 pages.
Written Opinion, dated Dec. 28, 2010 for PCT/US2010/035651, 3 pages.
Written Opinion, dated Dec. 30, 2014, for PCT/US2014/055909, 13 pages.
Written Opinion, dated Jul. 9, 2009 for PCT/US2009/043171, 8 pages.
Written Opinion, dated Jun. 10, 2009 for PCT/US2009/043170, 7 pages.
Written Opinion, dated Jun. 21, 2010 for PCT/US2009/064625, 5 pages.
Written Opinion, dated Nov. 29, 2010 for PCT/US2010/033000, 5 pages.
Written Opinion, dated Oct. 8, 2012 for PCT/US2012/033059, 3 pages.
Written Opinion, dated Sep. 29, 2011 for PCT/US2011/041402, 4 pages.
Amendment, filed Jun. 26, 2018, for U.S. Appl. No. 14/488,069, Renn et al., "Solid-State Lighting Devices and Systems," 7 pages.
Reed, "High Reliability Photocontrol Controls With 0 to 10 Volt Dimming Signal Line and Method," U.S. Appl. No. 15/980,978, filed May 16, 2018, 18 pages.

* cited by examiner

RECEPTACLE SOCKETS FOR TWIST-LOCK CONNECTORS

BACKGROUND

Technical Field

The present disclosure relates to electrical connectors, and more particularly to twist-lock connectors.

Description of the Related Art

Twist-lock connectors are used in many electrical applications where robust electrical connections and connector retention is desired. Historically, twist-lock connectors are made by crimping wire into stamped and formed electrical contacts made of brass, phosphor bronze, beryllium copper or other material. The electrical contacts are mounted in a base made of a non-conductive resin, such as Bakelite, or thermosetting plastic, or ceramic or other non-conductive material. The other end of the wires are then attached to a terminal block, connector, direct solder or other method of electrically connecting the wires to the module, lamp or Printed Circuit Board (PCB), which uses the electrical power or data conducted from the plugged-in connector (the connected device). The twist-lock connectors may include one or more female contacts that may electrically couple with corresponding male plug contacts.

Difficulties may arise when manufacturing traditional twist-lock connectors, which may therefore be prone to failure. For example, the stamped and formed contacts may not be perfectly formed so that the contact pressure of female contacts onto corresponding male plug contacts may vary greatly, leading to intermittent electrical connection, contact corrosion or loss of connection due to thermal expansion or contraction, or mechanical stress or vibration. In addition, crimping of the contacts to the wires may be incomplete or may damage the wire being crimped, thus causing failure of the connection. In some instances, the terminal block, connector or solder joint electrically connecting the wires to the module, lamp or Printed Circuit Board (PCB) may be improperly done, or may fail from thermal or mechanical stress or vibration. As a result, the wires may be strain relieved so that the wires will not break off or increase in electrical resistance when the wires are moved during servicing, or mechanical vibration.

Safety concerns may also be present in traditional twist-lock connectors. For example, the wires may become disconnected from either the crimped contact in the twist-lock connector, or the terminal block, receiving connector, solder joint, etc., and then move to make electrical connection with the conductive housing of the connected device, thereby presenting an electrical shock hazard.

In addition, the traditional twist-lock connector may also be relatively expensive to manufacture, with many steps of stamping and forming the contacts, crimping and terminating the wires, and may be difficult or expensive to install during final assembly of the connected device (for example, a luminaire) by requiring the assembler to install the wire ends into a terminal block through inserting a connector or soldering the wires into the connected device.

BRIEF SUMMARY

In some implementations, an electrical receptacle that accepts male twist-lock connectors may connect the corresponding contacts directly to an electronic printed circuit board without the need for stamped and formed contacts crimped to wires. In some implementations, the stamped and formed contacts may be eliminated in favor of either forming plated contacts on a PCB or soldering solid metal contacts to a PCB. In some implementations, crimping the wire and terminating the wire on stamped contacts may be eliminated by using traces on the PCB to connect to the circuitry on the PCB. Tolerances may be very tightly controlled (e.g., +/−0.003 inches) using PCB routing and plating production techniques. Such a PCB and electrical receptacle may be less expensive to produce compared to traditional twist-lock connectors by benefiting from the automatic assembly processes used in PCB fabrication and assembly.

A twist-lock connector that receives a set of male electrical contacts may be summarized as including: a set of female electrical receptacles that correspond to the set of male electrical contacts, the set of female electrical receptacles sized and dimensioned to receive the set of male electrical contacts, and the set of female electrical receptacles are physically engageable with the set of male electrical contacts when each of the male electrical contacts in the set of male electrical contacts are inserted into respective ones of the female electrical receptacles in the set of female electrical receptacles and rotated; a primary printed circuit board that has a first face and an opposing second face, the first face directed towards the female electrical receptacles; and a set of electrical connectors that correspond to the set of male electrical contacts, each of the electrical connectors positioned on respective ones of a set of flexible portions of the primary printed circuit board, each of the flexible portions resiliently deform responsive to one of the male electrical contacts contacting and exerting a force on the electrical connectors positioned on the flexible portion to provide a biasing force that urges the electrical connectors toward the male electrical contact.

The set of female electrical receptacles may include three female electrical receptacles arranged around a central point. The set of electrical connectors are comprised of brass plated with tin. Each of the flexible portions of the primary circuit board may be separated from remaining parts of the primary circuit board on a plurality of sides. Each flexible portion may comprise a proximal end and a distal end, the proximal end attached to the remaining part of the primary circuit board and the distal end separated therefrom. For each of the flexible portions, the electrical connector may be located proximate the distal end. The primary circuit board may include a composite mat that has a matrix, wherein the primary circuit board includes a pattern of elements, and wherein the pattern of elements is rotated by 60 degrees relative to the matrix of the composite mat. The twist-lock connector may further include: a secondary circuit board located on an opposite side of the female receptacles from the primary circuit board, the secondary circuit board includes a plurality of electrical connector pads arranged around a central axis. At least a subset of the plurality of electrical connector pads may provide dimming control for an electrically coupled luminaire. The twist-lock connector may further include: a support that is clamped next to the second face of the primary printed circuit board and biases the set of electrical connectors towards the female electrical receptacles. The twist-lock connector may further include: a screw that is threaded through and physically couples the support, the primary printed circuit board, and a mounting base that includes the set of female receptacles. The set of electrical connectors transitions to a biased position when the set of male electrical contacts may be rotatably engaged with the set of female electrical connections. The electrical connectors may include two opposing portions of the primary printed circuit board separated by a channel, wherein the channel is sized and positioned to engage with a respective one of the male electrical contacts when the male electrical contact is rotatably engaged with a corresponding one of the female electrical receptacles. Each of the respective flexible portions may include an internal tab that includes a fixed end and a free end. 15. At least one of the electrical connectors may include an electrical post.

A twist-lock connector that receives a set of male electrical contacts may be summarized as including a set of female electrical receptacles that correspond to the set of male electrical contacts, the set of female electrical receptacles sized and dimensioned to receive the set of male electrical contacts, and the set of female electrical receptacles are physically engageable with the set of male electrical contacts when each of the male electrical contacts in the set of male electrical contacts are inserted into respective ones of the female electrical receptacles in the set of female electrical receptacles and rotated; a primary printed circuit board that has a first face and an opposing second face, the first face directed towards the female electrical receptacles; and a set of electrical connectors that correspond to the set of male electrical contacts, each of the electrical connectors positioned on respective ones of a set of flexible portions of the primary printed circuit board, each of the flexible portions resiliently deform responsive to one of the male electrical contacts contacting and exerting a force on the electrical connector positioned on the flexible portion to provide a biasing force that urges the electrical connector toward the male electrical contact. The set of female electrical receptacles may include three female electrical receptacles arranged around a central point. The set of electrical connectors may be comprised of brass plated with tin. Each of the flexible portions of the primary circuit board may be separated from remaining parts of the primary circuit board on a plurality of sides. Each flexible portion may include a proximal end and a distal end, the proximal end attached to the remaining part of the primary circuit board and the distal end separated therefrom. For each of the flexible portions, the electrical connector may be located proximate the distal end. The primary circuit board may be comprised of a composite mat that may have a matrix, the primary circuit board may include a pattern of elements, and the pattern of elements may be rotated by a defined amount relative to the matrix of the composite mat. The matrix may include a first axis and a second axis, each flexible portion may extend in a direction from a proximal end to a distal end, and the pattern of elements on the primary printed circuit board may be rotated relative to the matrix of the composite mat such that the respective direction in which each flexible portion extends is parallel to at least one of the first axis and the second axis of the matrix.

The twist-lock connector may further include a secondary circuit board located on an opposite side of the female receptacles from the primary circuit board, the secondary circuit board including a plurality of electrical connector pads arranged around a central axis. At least a subset of the plurality of electrical connector pads may provide dimming control for an electrically coupled luminaire.

The twist-lock connector may further include a support base that is clamped next to the second face of the primary printed circuit board and limits deflection of the flexible portions away from the female electrical receptacles.

The twist-lock connector may further include a mounting base that includes the set of female receptacles, the mounting base located opposite the support base across the primary printed circuit board.

The twist-lock connector may further include a screw that is threaded through and operable to clamp the support base, the primary printed circuit board, and the mounting base, wherein the mounting base is rotatable relative to the screw.

The twist-lock connector may further include a twist-lock plug, the twist-lock plug including the set of male electrical contacts, wherein the twist-lock plug further includes a photo-control component, and the mounting base may be rotatable to selectively position the photo-control component. The flexible portions may transition to a deformed position when the set of male electrical contacts are rotatably engaged with the set of female electrical receptacles. The electrical connectors may be comprised of two opposing portions of the primary printed circuit board separated by a channel, and the channel may be sized and positioned to engage with a respective one of the male electrical contacts when the male electrical contact is rotatably engaged with a corresponding one of the female electrical receptacles. Each of the respective flexible portions may be comprised of an internal tab that includes a fixed end and a free end. At least one of the electrical connectors may be comprised of an electrical post. The electrical post may include a proximal end and an opposing distal end, the proximal end may be located relatively closer to the primary circuit board and the distal end may be located relatively away from the primary circuit board, and the distal end may include a chamfer or tapered portion at an end that may be directed away from the primary circuit board.

A method of physically coupling a twist-lock connector with a twist-lock plug, the twist-lock plug including a plurality of male electrical contacts, the twist-lock connector including a plurality of female electrical receptacles and a primary printed circuit board that includes a set of flexible portions, such flexible portions including an electrical contact and aligning with respective ones of the female electrical receptacles, may be summarized as including inserting each of the male electrical contacts of the twist-lock plug into respective ones of the female electrical receptacles, the female electrical receptacles guide the male electrical contacts towards the electrical contacts on respective ones of the flexible portions; twisting the twist-lock plug with respect to the twist-lock connector, such twisting which securely engages the male electrical contacts with the respective ones of the female electrical receptacles; and deforming at least one of the flexible portions by the male electrical contacts into a deformed position responsive to one of the male electrical contacts contacting and exerting a force on the electrical contact positioned on the flexible portion. Deforming at least one of the flexible portions may include deforming at least one of the flexible portions in which the at least one flexible portion is separated from remaining parts of the primary circuit board on a plurality of sides. Deforming at least one of the flexible portions may include deforming the at least one of the flexible portions in the primary printed circuit board, the at least one of the flexible portions including a proximal end and a distal end, the proximal end attached to the remaining part of the primary circuit board and the distal end separated therefrom. The primary circuit board may be comprised of a composite mat that may have a matrix that includes a first axis and a second axis, and deforming at least one of the flexible portions may include deforming the at least one of the flexible portions of the primary printed circuit board, the primary circuit board including a pattern of elements, and the pattern of elements being rotated by a defined amount relative to the matrix of the composite mat.

The method may further include clamping a support base next to the primary printed circuit board, the support base which limits deflection of the flexible portions away the female electrical receptacles.

The method may further include clamping a mounting base to the primary printed circuit board, the mounting base which includes the plurality of female receptacles, the mounting base which is located opposite the support base across the primary printed circuit board.

The electrical contacts may be comprised of two opposing portions of the primary printed circuit board separated by a channel, and may further include engaging respective ones of the male electrical contacts within corresponding channels when the male electrical contact is rotatably engaged with a corresponding one of the female electrical receptacles.

A method of manufacturing a twist lock connector that includes a mounting base, a support base, and a primary printed circuit board, the mounting base which includes at least one female electrical receptacle, may be summarized as including routing one or more portions of the primary printed circuit board to form one or more cut out sections, each cut out section surrounding a respective flexible portion of the primary printed circuit board in which each respective flexible portion resiliently deforms responsive to a force being applied to the flexible portion; mounting the primary printed circuit board between the mounting base and the support base; and clamping the mounting base, the primary printed circuit board, and the support base such that each of the at least one female electrical receptacles is aligned with respective ones of the flexible portions of the primary printed circuit board. Routing one or more portions of the primary printed circuit board to form one or more cut out sections may include routing at least three portions of the primary printed circuit board to form at least three flexible portions of the primary printed circuit board.

The method may further include electrically coupling a set of electrical connectors to the primary printed circuit board, at least one electrical connector in the set of electrical connectors being electrically coupled to one of the flexible portions of the primary printed circuit board, wherein at least one of the electrical connectors in the set of electrical connectors may be comprised of brass plated with tin.

The primary printed circuit board may be comprised of a composite mat that may have a matrix that includes a first axis and a second axis and the primary printed circuit board may include a pattern of elements, and the method may further include rotating the pattern of elements in the primary printed circuit board a defined amount relative to the matrix of the composite mat. The matrix may include a first axis and a second axis, each flexible portion extending in a direction from a proximal end to a distal end, and rotating the pattern of elements on the primary printed circuit board may include rotating the pattern of elements on the primary printed circuit board such that the respective direction in which each flexible portion extends is parallel to at least one of the first axis and the second axis of the matrix. Clamping the mounting base, the primary printed circuit board, and the support base may further include clamping the support base and the primary printed circuit board to thereby limit an amount of deflection of the flexible portions of the primary printed circuit board away from the female electrical receptacles in response to the force being applied to the flexible portions.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

Figure 1:
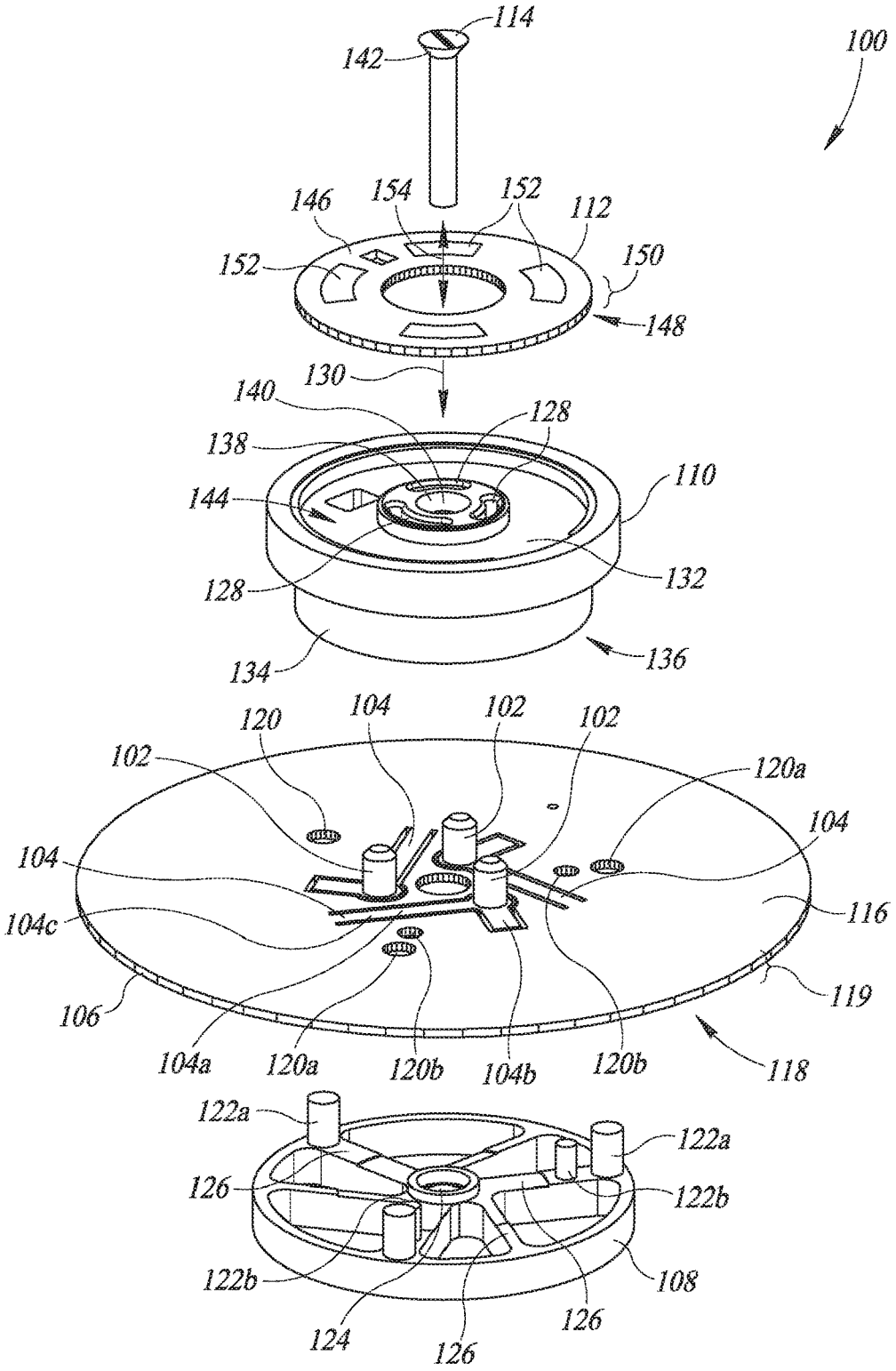
FIG. 1 is an exploded elevated isometric view of a twist-lock connector that includes three printed circuit board ("PCB") electrical connectors located on respective flexible portions, according to at least one illustrated implementation.

FIG. 1 shows components of a twist-lock connector 100 that includes three PCB mounted electrical connectors 102 located on respective flexible portions 104 of a primary PCB 106, according to at least one illustrated implementation. The twist-lock connector 100 may include the primary PCB 106, a support base 108, a mounting base 110, a secondary PCB 112, and a mounting coupler 114.

The primary PCB 106 may include a first face 116 and an opposing second face 118 opposed across a thickness 119. The first face 116 and the second face 118 may each be planar, and may be parallel to each other. The primary PCB 106 may be comprised of one or more of a non-conductive resin or composite, such as fiberglass FR4, epoxy/Kevlar fiber or thermosetting plastic, or ceramic, or metal covered with nonconductive coating or film, or other non-conductive material. In some implementations, the primary PCB 106 may be circular in shape and may have a diameter of about 5 inches, although such shapes and dimensions should not be considered limiting. In some implementations, the primary PCB 106 may include a plurality of electrical traces or other electrically conductive pathways for conducting electrical signals. The primary PCB 106 may include one or more apertures ("vias") that extend between the first face 116 and the second face 118, with such apertures being used to electrically couple electronic components to one or more of the electrical traces or other conductive pathways. Such electrical coupling may be performed, for example, manually through soldering the electronic components, and/or such electrical coupling may be performed, for example, mechanically or automatically using pick-and-place technology. In some implementations, the electronic components and electrical traces and/or pathways may form an electronic circuit that performs one or more defined tasks. For example, in some implementations, such an electronic circuit may be used to control the operation of one or more luminaires, such as, for example, luminaires that provide lighting for roadways, streets, parking lots, and other large spaces.

The primary PCB 106 may include one or more flexible portions 104 that may each support one or more PCB mounted electrical connectors 102. For example, as shown in FIG. 1, each of the flexible portions 104 in the primary PCB 106 may support a respective PCB electrical connector 102. The flexible portions 104 may be formed within the primary PCB 106 using a standard PCB routing process to form cutouts adjacent to one or more sides of the flexible portion 104 by removing a portion of the primary PCB 106. In some implementations, each of the flexible portions 104 may be comprised of an internal tab 104*a* that includes a free end 104*b* that is physically separated from the remaining part of the primary PCB 106, and a fixed end 104*c* that is fixed to or continuous with the remaining part of the primary PCB 106.

In some implementations, the flexible portion 104 may be formed within an interior section of the primary PCB 106 by cutting out, routing, and/or otherwise removing portions of the primary PCB 106. In some implementations, a plurality of sides of the flexible portion 104 may be physically separated from the remaining part of the primary PCB 106. In some implementations, for example, the flexible portion 104 may form an "L" shape within the primary PCB 106 in which only the top part of the "L" is attached to the primary PCB 106. The PCB 106 proximate the remaining sides of the L-shaped flexible portion 104 may be cut out, routed, or otherwise removed, thereby creating a separation or void between the flexible portion 104 and the remaining part of the primary PCB 106 along these remaining sides. Such separation may enable the flexible portion 104 to flex, deform, and move relative to the remaining part of the primary PCB 106.

The PCB mounted electrical connectors 102 may be comprised of conductive components soldered, riveted or otherwise attached to the flexible portions 104 of the primary PCB 106. In some implementations, the PCB mounted electrical connectors 102 may be plated on the flexible portions 104 using standard PCB manufacturing processes. In some implementations, plating may be formed around the edge of the flexible portions 104 to make contact with male electrical contacts that may be inserted into the twist-lock connector 100, and as such, may require that no contacts be soldered and/or crimped to electrical connections from the primary PCB 106. In some implementations, gold, tin, or other highly conductive metals may be plated on the flexible portions 104 to achieve the relatively low resistance and contact corrosion resistance for the PCB mounted electrical connectors 102. In some implementations, the PCB mounted electrical connectors 102 may be cylindrical metal components supplied in tape and reel packaging, and automatically placed on the primary PCB 106 during standard automatic pick and place assembly, along with other components in the twist-lock connector 100. In some implementations, the PCB mounted electrical connectors 102 may include an electrical post with a chamfer or tapered portion at an end that is directed towards the mounting base 110. Such a chamfer or tapered portion may facilitate engagement with other electrical connectors. Physical attachment and electrical connections may be made by reflow soldering with contacts that may be RoHS certified brass plated with tin, for example.

The flexible portion 104 may be resiliently deformable. As such, when a force is applied against the flexible portion 104, as may occur, for example, when male electrical contacts come into contact with the PCB mounted electrical connectors 102, the flexible portion 104 may exert a biasing force in an opposing direction. In some implementations, such an opposing force may be determined according to Hooke's Law of Spring Force that provides a linear relationship of force to distance of compression of the spring. As such, the biasing force applied by the flexible portion 104 may urge the PCB mounted electrical connectors 102 towards the male electrical contacts. A process of routing the primary PCB 106 to form the flexible portions 104 may provide advantages over conventional processing in which contacts are stamped by sequential stamping dies such that the contacts may have poor tolerances caused by die wear or other process variations. The tooling used for sequential stamping may be expensive, especially as compared to the tooling used for PCB fabrication. In addition, the contact force resulting from the flexible portions 104 may be better controlled, with less variation between different flexible portions 104, because of the close dimensional tolerances used in PCB fabrication. In some implementations, one or both of the support base 108 and/or the mounting base 110 may be used to provide additional support for the flexible portions 104.

In some implementations, the primary PCB 106 may include one or more registration apertures 120 that may be used to align the primary PCB 106 with one or more other components in the twist-lock connector 100. For example, the primary PCB 106 includes three major registration apertures 120*a* and two minor registration apertures 120*b* that may be aligned with corresponding major registration projections 122*a* and minor registration projections 122*b* on the support base 108 to thereby align the primary PCB 106 with the support base 108.

The support base 108 may be comprised of non-conducting material. Such non-conducting material may include, for example, plastic resin, such as ABS resin. In some implementations, the support base 108 may include a threaded portion 124 that may be coupleable to the mounting coupler 114, such as a screw. In some implementations, the support base 108 may include one or more spring guides 126 in which each spring guide 126 may be aligned with at least a part of a respective one of the flexible portions 104 on the primary PCB 106. When the components of the twist-lock connector 100 are clamped together, each of the spring guides 126 may be proximate to or in contact with the part of the respective flexible portion 104 of the primary PCB 106. As such, when the male electrical contacts apply a force against the PCB mounted electrical connectors 102 going towards the support base 108, placing the flexible portions 104 in a deformed position, the spring guides 126 in the support base 108 may exert an opposing force, directed towards the mounting base 110, against the respective flexible portions 104 of the primary PCB 106. Such a force, applied by the spring guides 126 against the flexible portions 104, may result in the position of the flexible portions 104 being maintained with respect to the remaining part of the primary PCB 106 (e.g., at least a portion of the outer surfaces of the flexible portions 104 may be maintained within the planes formed by the first face 116 and the second face 118, respectively).). In some implementations, the spring guides 126 may be used to limit an amount of deflection of the flexible portions 104 when the flexible portions 104 are in a deformed position.

The mounting base 110 may be comprised of non-conducting material. Such non-conducting material may include, for example, plastic resin, such as ABS resin. The mounting base 110 may be positioned between the primary PCB 106 and the secondary PCB 112. The mounting base 110 may include one or more female electrical receptacles 128 that may each be sized and dimensioned to securely receive a corresponding male electrical contact. Such male electrical contacts may be inserted into the respective ones of the female electrical receptacles 128 along a directed axis 130 that runs from the mounting base 110 to the primary PCB 106. The female electrical receptacles 128 may be used to guide each male electrical contact towards one of the PCB mounted electrical connectors 102.

Once inserted into the female electrical receptacles 128, the male electrical contacts may be rotated clockwise and/or counter-clockwise to securely lock the male electrical contacts with the female electrical receptacles. In some implementations, as discussed below for example, the male electrical contacts may be part of a turn-lock plug in which the male electrical contacts have a distal end that includes an offset portion that can be inserted fully into the corresponding female electrical receptacles 128. When turned, the offset portion of the male electrical contacts may engage with a corresponding edge or lip within each respective female electrical receptacle 128 that holds the distal end within the respective female electrical receptacle 128. When locked within the female electrical receptacles 128, the male electrical contacts may be maintained in contact, and thereby be electrically coupled, with the PCB mounted electrical connectors 102. The chamfer or tapered sections of the PCB mounted electrical connectors 102 may thereby facilitate the engagement and electrical coupling with the male electrical contacts. When securely engaged, the male electrical contacts may place the flexible portions 104 in a deformed or deflected position.

The mounting base 110 may include a mounting base surface 132 that faces towards the secondary PCB 112 and a side wall 134 that may extend from the first mounting base surface 132 towards the primary PCB 106. In some implementations, the mounting base surface 132 and the side wall 134 may form a cavity 136 that has an opening that faces towards the primary PCB 106. The cavity 136 may include one or more spring guides (see, e.g., FIG. 5 and FIG. 6) that may be used to maintain the position of the flexible portions 104 of the primary PCB 106 with respect to the other portions of the primary PCB 106 (e.g., at least a portion of the outer surfaces of the flexible portions 104 may be maintained within the planes formed by the first face 116 and the second face 118, respectively). The first mounting base surface 132 may include a recessed portion 144 that may be sized and dimensioned to receive the secondary PCB 112.

The mounting base 110 may include a central aperture 138 that may enable the mounting coupler 114 to pass through from the mounting base surface 132 towards the support base 108. In some implementations, the central aperture 138 may include an enlarged portion 140 that may be used to next an upper portion 142 of the mounting coupler 114 such that the mounting coupler 114 is flush with the mounting base surface 132 when the mounting coupler 114 is engaged with the support base 108 to thereby clamp together the components of the twist-lock connector 100. The female electrical receptacles 128 may be arranged around the central aperture 138.

The secondary PCB 112 may include a first surface 146 and an opposing second surface 148 separated by a thickness 150. The secondary PCB 112 may be annular in shape and may be sized to be received within the recessed portion 144 of the mounting base 110. In some implementations, the secondary PCB 112 may be physically coupled to the mounting base 110 within the recessed portion 144 using silicone or some other adhesive. The mounting coupler 114 may pass through the central open area of the annular region. In some implementations, the secondary PCB 112 may include one or more electrical contact pads 152 that may electrically couple with electrical contacts on other devices mounted on the twist-lock connector 100. The electrical contact pads 152 may be arranged around a central axis 154 that extends through the central portion of the secondary PCB 112. In some implementations, two or four electrical contact pads 152 may be used to provide a five or seven pin NEMA photo-control twist lock socket, respectively. Such electrical contact pads 152 may be used to provide low voltage control of the controllable device. For example, many luminaires have 0 to 10 volt dimming control, where the low voltage signal sets the brightness of the luminaire.

Digital Addressable Lighting Interface (DALI) control may use two low voltage control lines, which may be connected via two of the electrical contact pads 152. In some implementations, the electrical contact pads 152 may be plated with corrosion resistant plating such as gold or tin plating. In some implementations, the electrical contact pads 152 may be connected to the primary PCB 106 by a pluggable post and header connector. Such a pluggable post and header connector may thereby physically couple the secondary PCB 112 to the other components of the twist-lock connector 100.

The mounting coupler 114 may extend through one or more components of the twist-lock connector 100 to thereby clamp such components together. In some implementations, the mounting coupler 114 may be a screw with a countersunk head that may be securely received within the enlarged portion 140 of the central aperture 138 of the mounting base 110. The mounting coupler 114 may extend through the central aperture 138 of the mounting base 110, the primary PCB 106 and be coupled with a corresponding coupling device in the support base 108. Such a coupling device may include, for example, a threaded portion that may receive a corresponding threaded cavity of the mounting coupler 114. When so coupled, the mounting coupler 114 may thereby clamp together one or more components of the twist-lock connector 100.

Figure 2:
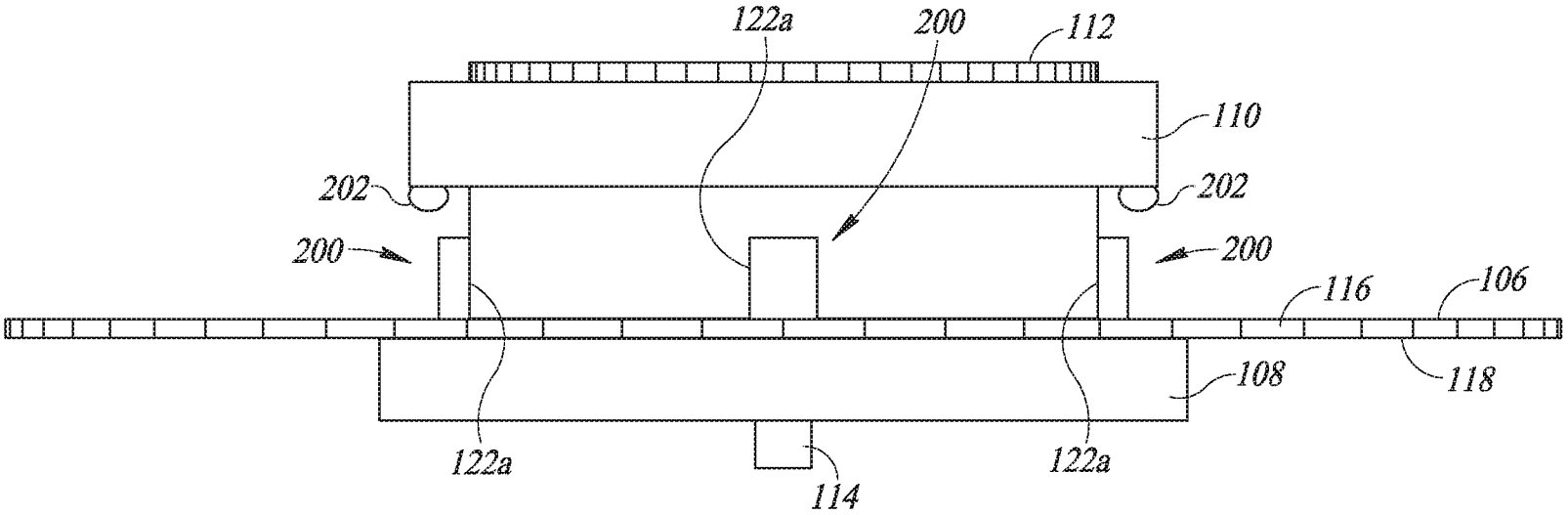
FIG. 2 is a side elevational view of a twist-lock connector, according to at least one illustrated implementation.

FIG. 2 shows the twist-lock connector 100 in which the mounting base 110, the primary PCB 106, and the support base 108 are clamped together by the mounting coupler 114, according to at least one illustrated implementation. In some implementations, the secondary PCB 112 may be physically and/or electrically coupled to the primary PCB 106 via a pluggable post and header connector (not shown). In some implementations, the secondary PCB 112 may be physically coupled to the mounting base 110 using silicone or some other adhesive. The major registration projections 122*a* of the support base 108 may extend through the registration apertures 120 from the first face 116 to the opposing second face 118 of the primary PCB 106. In some implementations, a distal portion 200 of the major registration projections 122*a* may be located proximate the side wall 134 of the mounting base 110. In some implementation, the distal portions 200 of the major registration projections 122*a* may come into contact with, and potentially engage, with a luminaire casting (not shown). In such an implementation, the primary PCB 106 and support base 108 may be located within a cavity created by the luminaire casting, and the secondary PCB 112 and portions of the mounting base 110 may be located on an exterior portion of the luminaire casting. The mounting base 110 may include an annular seal 202 that may extend around a circumference of a portion of the mounting base 110. In some implementations, the annular seal 202 may engage with and be compressed by the luminaire casting to thereby form a seal to prevent water and/or particulates from entering an interior portion of the luminaire. Such a seal may further provide a frictional force between the twist-lock connector 100 and luminaire casting to prevent rotation of the twist-lock connector 100.

Figure 3:
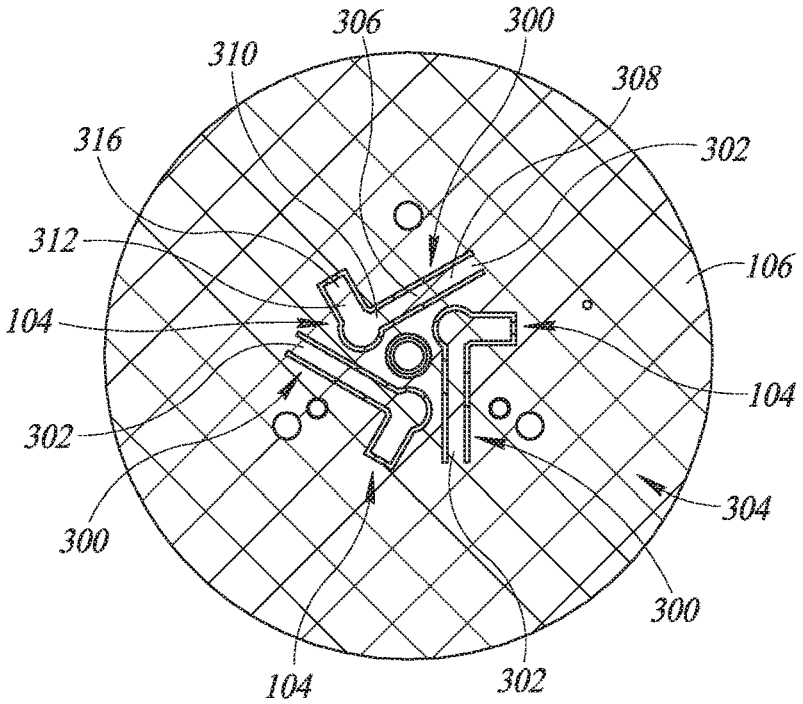
FIG. 3 is a top plan view of a primary PCB that is included within a twist-lock connector and that includes three flexible portions, each of which supports a PCB electrical connector, according to at least one illustrated implementation.

FIG. 3 shows the primary PCB 106 with three flexible portions 104, each of which may support a PCB electrical connector 102 (not shown), according to at least one illustrated implementation. The primary PCB 106 may be comprised of one or more of a non-conductive resin or composite, such as fiberglass FR4, or thermosetting plastic, or ceramic, or metal covered with nonconductive coating or film. In some implementations, the primary PCB 106 may be circular in shape and may have a diameter of about 5 inches or less, of between about 5 inches and 9 inches, or of about 9 inches or more, although such shapes and dimensions should not be considered limiting. In some implementations, the primary PCB 106 may include a plurality of electrical traces or other electrically conductive pathways for conducting electrical signals. The primary PCB 106 may include one or more apertures that extend between the first face 116 and the second face 118, with such apertures being used to electrically couple electronic components to one or more of the electrical traces or other conductive pathways. The primary PCB 106 may include a PCB laminate, such as a composite mat that has a composite mat matrix 304. In some implementations, the PCB pattern (e.g., the pattern of elements, such as electrical components, on the primary PCB 106) may be rotated with respect to the axis formed by the composite mat matrix 304. Such rotation, which may be by 60° for example, may provide each flexible portion 104 to have a similar alignment to the composite mat matrix 304. Such similarity in alignment with respect to the composite mat matrix 304 may reduce any variation between the forces applied by each respective flexible portion 104 on the primary PCB 106 when the flexible portions 104 are deformed. In some implementations, the force applied by each respective flexible portion 104 on the primary PCB 106 when the flexible portions 104 are deformed may be substantially equal.

The flexible portions 104 may be formed using cutouts 300 in which a part of the primary PCB 106 adjacent the flexible portions 104 have been removed. Such cutouts 300 may be formed within the primary PCB 106 using a standard PCB routing process to remove part of the primary PCB 106. For example, in some implementations, cutouts 300 may be formed along a plurality of sides of the flexible portion 104. Such a flexible portion 104 may be resiliently deformed when a force is applied against the flexible portion 104, as may occur, for example, when male electrical contacts come into contact with the PCB mounted electrical connectors 102. As a result, the flexible portion 104 that has been deflected may exert a force in an opposing direction. When the original force is removed, the flexible portion 104 may return to a non-deflected state wherein the flexible portion 104 is coplanar with the remainder of the primary PCT 106.

In some implementations, the opposing force provided by a flexible portion 104 that has been deflected may be determined according to Hooke's Law of Spring Force that provides a linear relationship of force to distance of deflection of the spring. As such, the flexible portion 104 may generate a contact force based upon the displacement and/or deformation caused by the male electrical contacts applying a force in the opposite direction against the PCB mounted electrical connectors 102. A process of routing the primary PCB 106 to form the cutouts 300 may provide advantages over conventional processing in which contacts are stamped by sequential stamping dies such that the contacts may have poor tolerances caused by die wear or other process variations. In addition, the contact force resulting from the flexible portions 104 may be better controlled, with less variation between different flexible portions 104, because of the close dimensional tolerances used in PCB fabrication. In some implementations, one or both of the support base 108 and/or the mounting base 110 may be used to provide additional support for the flexible portions 104.

The flexible portion 104 may include multiple portions, as shown in FIG. 3. In such an implementation, for example, the flexible portion 104 may include a primary section 306 that may have a proximal end 308 and a distal end 310. The primary section 306 may be contiguous with the remaining portion of the primary PCB 106 at the proximal end 308.

Cutouts 300 may be present along both sides of the primary section 306 that extend from the proximal end 308 to the distal end 310. The flexible portion 104 may include a secondary section 312 that has a proximal end 314 and a distal end 316. The proximal end 314 of the secondary section 312 of the flexible portion 104 may be contiguous with the distal end 310 of the primary section 306 of the flexible portion 104. The remaining portion of the secondary section 312 may be surrounded by cutouts 300. Such a flexible portion 104 may thereby form an "L" shape within the primary PCB 106 in which only the top part of the "L" (corresponding to the proximal end 308 of the primary section 306) is attached to the remaining portion of the primary PCB 106. In some implementations, the PCB mounted electrical connectors 102 may be positioned along or proximate the area in which the primary section 306 and the secondary section 312 of the flexible portion 104 meet (e.g., proximate the distal end 310 of the primary section 306).

Figure 4:
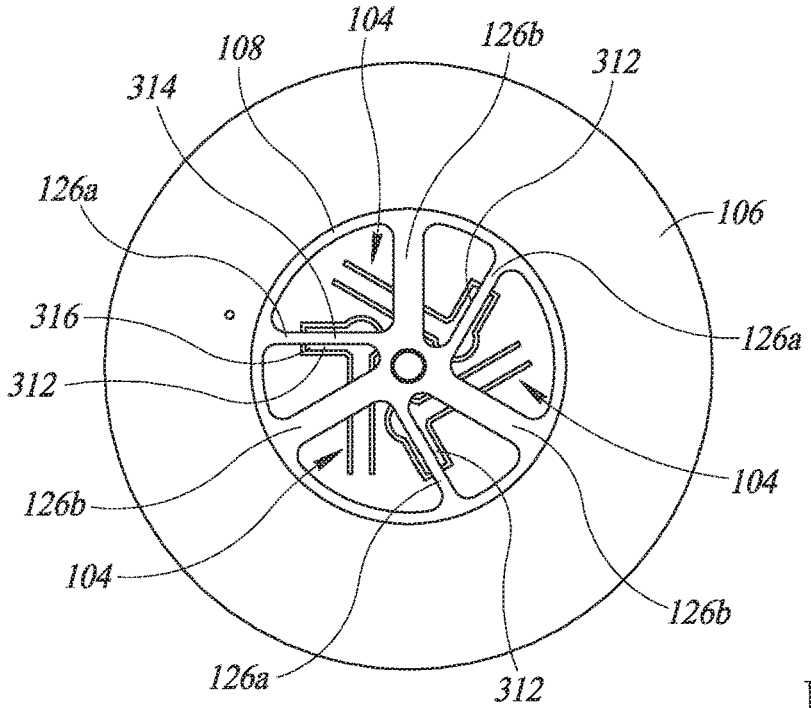
FIG. 4 is a bottom plan view of the primary PCB of FIG. 3 positioned relative to a support base, according to at least one illustrated implementation.

FIG. 4 shows the second face 118 of the primary PCB 106 positioned relative to the support base 108, according to at least one illustrated implementation. In some implementations, the support base 108 may be comprised of non-conducting material. Such non-conducting material may include, for example, plastic resin, such as ABS resin. In some implementations, the support base 108 includes the threaded portion 124 that may couple with the mounting coupler 114, such as a screw, to clamp together the components of the twist-lock connector 100.

The support base 108 may include a plurality of spring guides 126, each of which may be aligned with at least part of the flexible portions 104 in the primary PCB 106. In some implementations, at least some of the spring guides 126 may be aligned with at least a part of the flexible portions 104 of the primary PCB 106. For example, as shown in FIG. 4, a plurality of first spring guides **126*a* may each be aligned with a secondary section 312 of respective ones of the flexible portions 104 of the primary PCB 106. As such, the first spring guides 126*a* may extend from the proximal end 314 past the distal end 316 of the secondary section 312 of the flexible portion 104. In some implementations, at least some of the spring guides 126 may extend across at least a part of the flexible portions 104 of the primary PCB 106. For example, a plurality of second spring guides 126*b* (collectively, with first spring guides 126*a*, "spring guides 126") may extend at an angle across part of the primary section 306 of the flexible portion 104 of the primary PCB 106**.

In some implementations, the spring guides 126 may be used to maintain the position of the flexible portions 104 of the primary PCB 106 with respect to the other portions of the primary PCB 106 (e.g., at least a portion of the outer surfaces of the flexible portions 104 may be maintained within the planes formed by the first face 116 and the second face 118, respectively). In some implementations, the spring guides 126 may be used to limit an amount of deflection of the flexible portions 104 when the flexible portions 104 are in a deflected state. The spring guides 126 may exert a force against the secondary section 312 of the flexible portions 104 in the direction of the mounting base 110 when the flexible portions 104 are in a deflected state. Such spring guides 126 may prevent twisting or other deformations of the flexible portions 104 when the flexible portions 104 are in a deflected state, such as when corresponding male electrical contacts come into contact with the PCB mounted electrical connectors 102.

Figure 5:
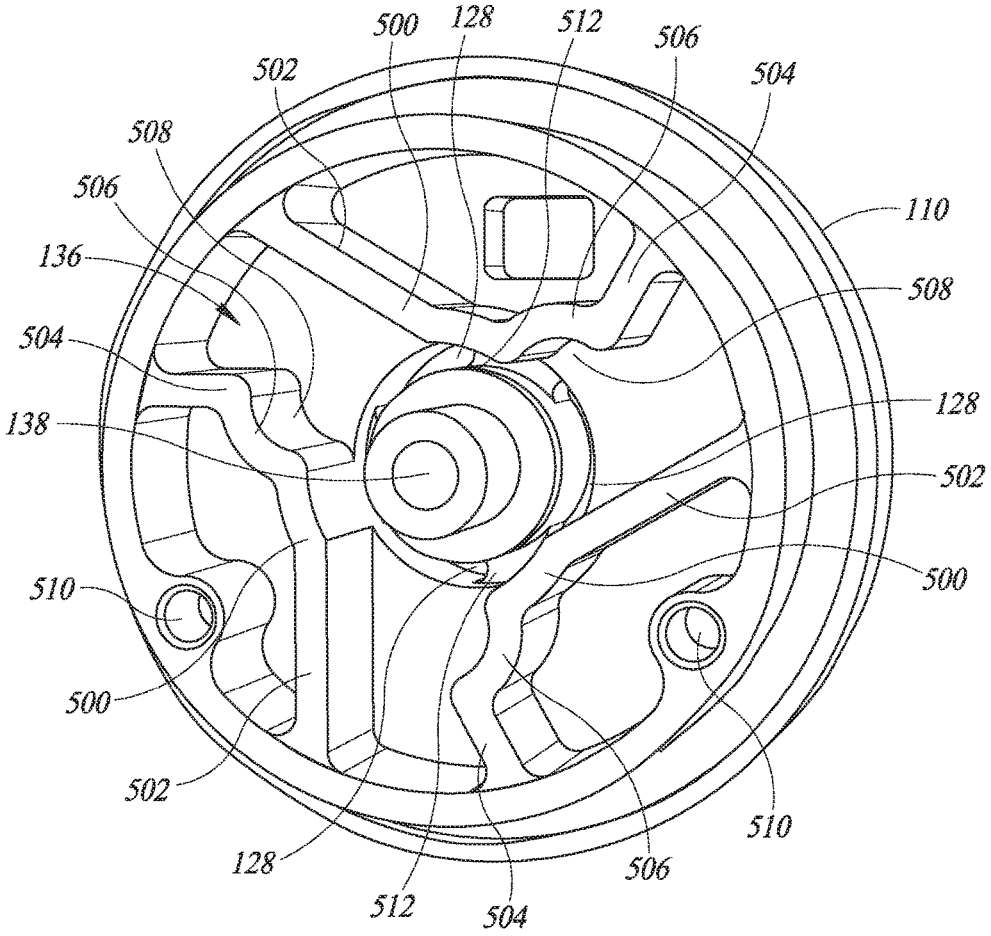
FIG. 5 is an isometric view of a cavity of a mounting base that includes a plurality of spring guides, according to at least one illustrated implementation.
Figure 6:
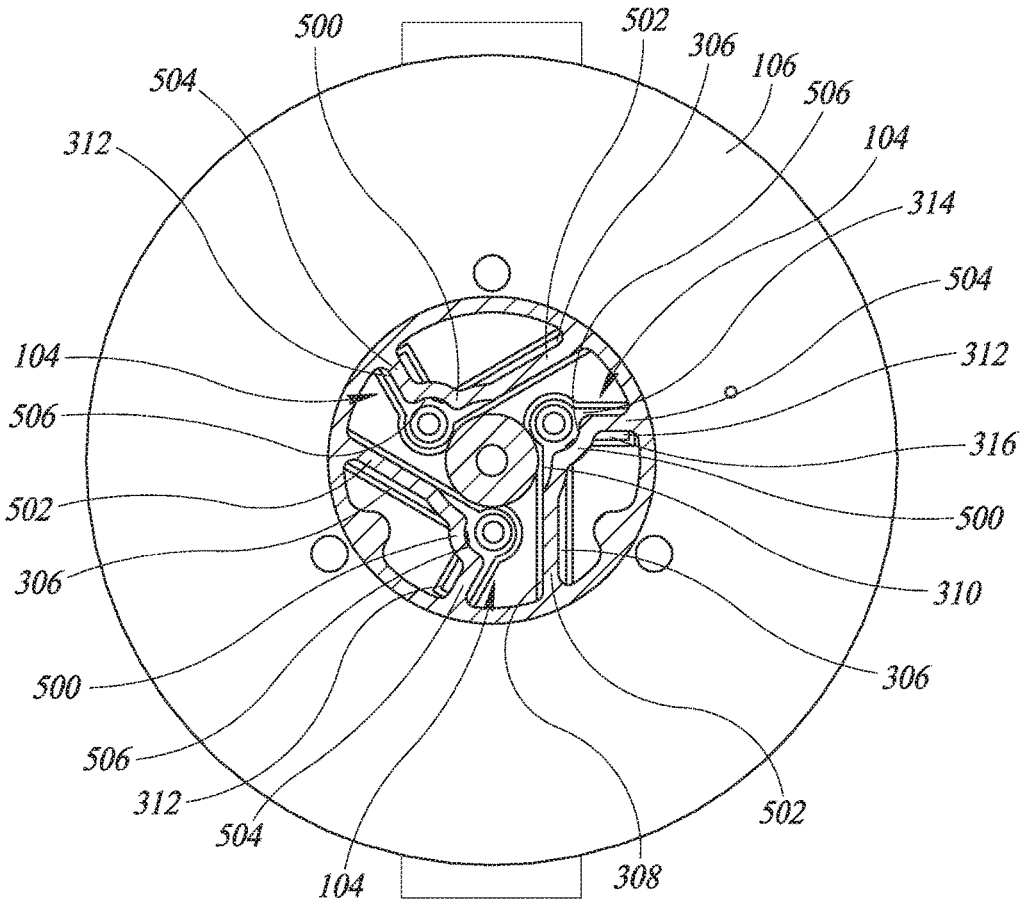
FIG. 6 is a top plan view of the mounting base of FIG. 5 aligned with a PCB physically in which a portion of the mounting base is cut away to show the position of each of the plurality of spring guides with respect to the flexible portions of the PCB, according to at least one illustrated implementation.

FIG. 5 shows the cavity 136 of the mounting base 110 that includes a plurality of spring guides 500, according to at least one illustrated implementation. FIG. 6 shows a cutaway view of the mounting base 110 that is aligned with the primary PCB 106 to show the position of each of the plurality of spring guides 500 in the mounting base 110 with respect to the flexible portions 104 of the primary PCB 106, according to at least one illustrated implementation. The mounting base 110 may be comprised of non-conducting material. Such non-conducting material may include, for example, plastic resin, such as ABS resin. The spring guides 500 of the mounting base 110 may be comprised of two parts, a primary part 502 that aligns with the primary section 306 of the flexible portion 104 of the primary PCB 106, and a secondary part 504 that aligns with the secondary section 312 of the flexible portion 104 of the primary PCB 106. As such, when the mounting base 110 is aligned with the primary PCB 106, the primary part 502 of the spring guide 500 may extend from the proximal end 308 towards the distal end 310 of the primary section 306 of the flexible portion 104 of the primary PCB 106. When the mounting base 110 is aligned with the primary PCB 106, the secondary part 504 of the spring guide 500 may extend from the proximal end 314 towards the distal end 316 of the secondary section 312 of the flexible portion 104 of the primary PCB 106. As such, the primary part 502 and/or the secondary part 504 of the spring guides 500 in the mounting base 110 may be used in some implementations to maintain the position of the flexible portions 104 of the primary PCB 106 with respect to the other portions of the primary PCB 106 (e.g., at least a portion the outer surfaces of the flexible portions 104 may be maintained within the planes formed by the first face 116 and the second face 118, respectively). In some implementations, the primary part 502 and/or the secondary part 504 of the spring guides 500 in the mounting base 110 may be used to limit an amount of deflection of the flexible portions 104 when the flexible portions 104 are in a deflected state.

In some implementations, a curved section 506 of each of the spring guides 500 may extend between the primary part 502 and the secondary part 504 of the spring guide in the mounting base 110. Such a curved section 506 may have a radius of curvature that provides sufficient space for the PCB mounted electrical connectors 102 (FIG. 1) to extend out from the primary PCB 106 towards the mounting base 110. In some implementations, the curved section 506 may include an interior concave wall 508 that may be located proximate the PCB mounted electrical connectors 102 when the primary PCB 106 and mounting base 110 are aligned. As such, the interior concave wall 508 may be used to maintain the position of the respective PCB mounted electrical connectors 102 when the male electrical contacts are inserted into the female electrical receptacles 128 and twisted to thereby securely engage and electrically couple the male electrical contacts with the PCB mounted electrical connectors 102. For example, in some implementations, the male electrical contacts may be part of a turn-lock plug in which the male electrical contacts have a distal end that includes an offset portion that can be inserted fully into the corresponding female electrical receptacles 128. When turned, the offset portion of the male electrical contacts may engage with a corresponding edge or lip 512 for each respective female electrical receptacle 128 that may holds the distal end of the male electrical contact within the respective female electrical receptacle 128. When locked within the female electrical receptacles 128, the male electrical contacts may be maintained in contact, and thereby be electrically coupled, with the PCB mounted electrical connectors 102.

When securely engaged, the male electrical contacts may place the flexible portions 104 of the primary PCB 106 in a deflected position.

In some implementations, the mounting base 110 may include one or more registration cavities 510 that may engage with one or more corresponding minor registration projections 122*b* (FIG. 1) from the support base 108. In some implementations, the registration cavities 510 may be placed in a non-symmetrical formation within the cavity 136 of the mounting base 110 such that the registration cavities 510 properly align with the corresponding registration projections 112*b* of the support base 108 in only one configuration.

Figure 7:
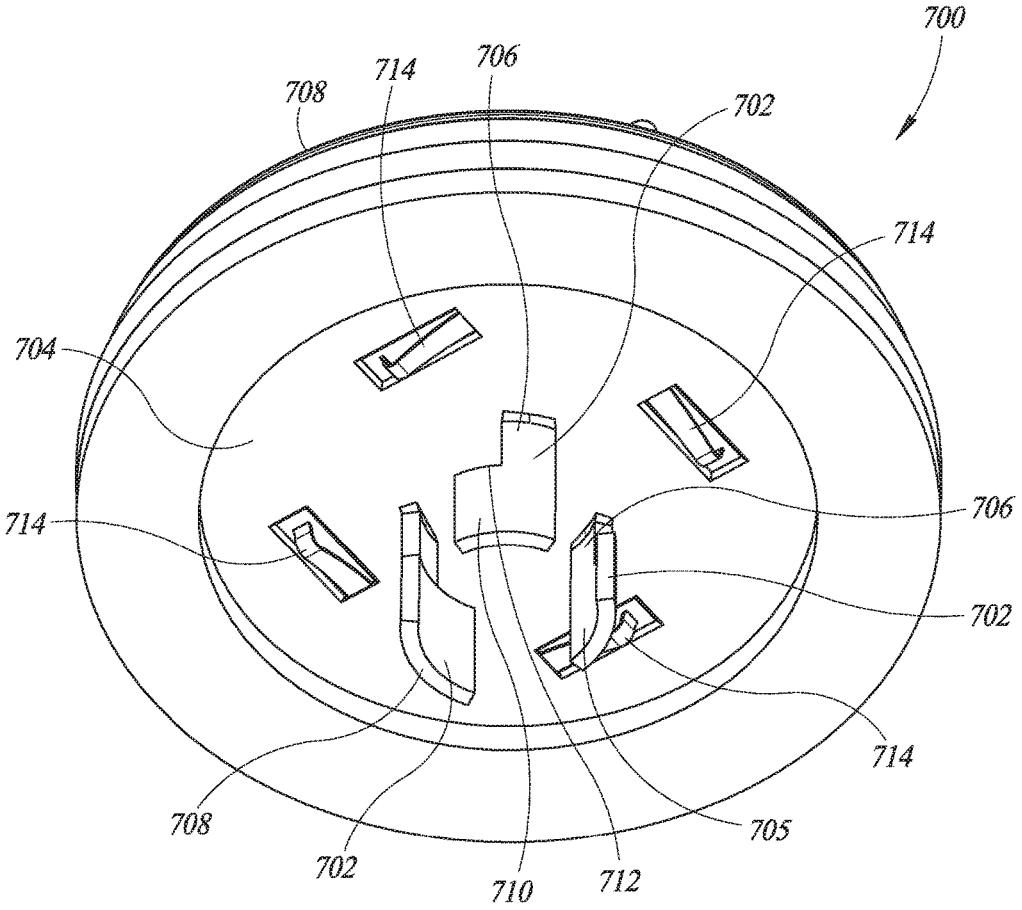
FIG. 7 is a bottom isometric view of a bottom surface of a twist-lock connector with three male electrical contacts, according to at least one illustrated implementation.

FIG. 7 shows a bottom surface 704 of a twist-lock plug 700 with three male electrical contacts 702, according to at least one illustrated implementation. The male electrical contacts 702 may include a proximal part 706 and a distal part 708 in which the proximal part 706 is located relatively closer to the bottom surface 704, and the distal part 708 is located relatively away from the bottom surface 704. The proximal part 706 may extend perpendicularly out from the bottom surface 704 of the twist-lock plug 700. In some implementations, the distal part 708 may include an offset portion 710 that is offset from the proximal part 706 of the male electrical contact 702. The offset portion 710 may include an edge 712 that extends parallel to the bottom surface 704 of the twist-lock plug 700. When the male electrical contacts 702 are inserted into the female electrical receptacles 128 and twisted, the edge 712 of the offset portion 710 of the male electrical contacts 702 may engage with the corresponding edge or lip 512 (FIG. 5) of the female electrical receptacle 128 to thereby securely engage and physically couple the twist-lock plug 700 with the mounting base 110 of the twist-lock connector 100.

In some implementations, the twist-lock plug 700 may include one or more electrical connectors 714 that may be used to electrically couple with the electrical contact pads 152 on the secondary PCB 112. Such electrical connectors 714 and corresponding electrical contact pads 152 may be used for a five or seven pin NEMA photo-control twist-lock socket, respectively, that may provide low voltage control of the controllable device. For example, many luminaires have 0 to 10 volt dimming control, where the low voltage signal sets the brightness of the luminaire. Digital Addressable Lighting Interface (DALI) control may include two low voltage control lines, which may be connected via two sets of the electrical connectors 714 and corresponding electrical contact pads 152.

In some implementations, the twist-lock plug 700 may provide photo-control for a luminaire when engaged and electrically coupled with a corresponding twist-lock connector 100 in the luminaire. In such an implementation, the mounting coupler 114 in the twist-lock connector 100 may be loosened, allowing for the rotation of the remaining components of the twist-lock connector 100 such that the photo-control components in the twist-lock plug 700 may be aligned to a more optically favorable position. Projections 122*b* engage in recesses 510 to keep the mounting base 110, the primary PCB 106 and/or the support base 108 aligned during rotation. The mounting coupler 114 may then be tightened to clamp together the components of the twist-lock connector 100, thereby maintaining the position of the twist-lock connector 100. The twist-lock plug 700 with the photo-control may then be engaged with and installed in the twist-lock connector 100. Such a rotatable feature may be advantageous in installations where there may be other light sources or light reflectors (such as tree branches) which may cause undesirable operation of the photo-control if not oriented in a particular direction.

Figure 8:
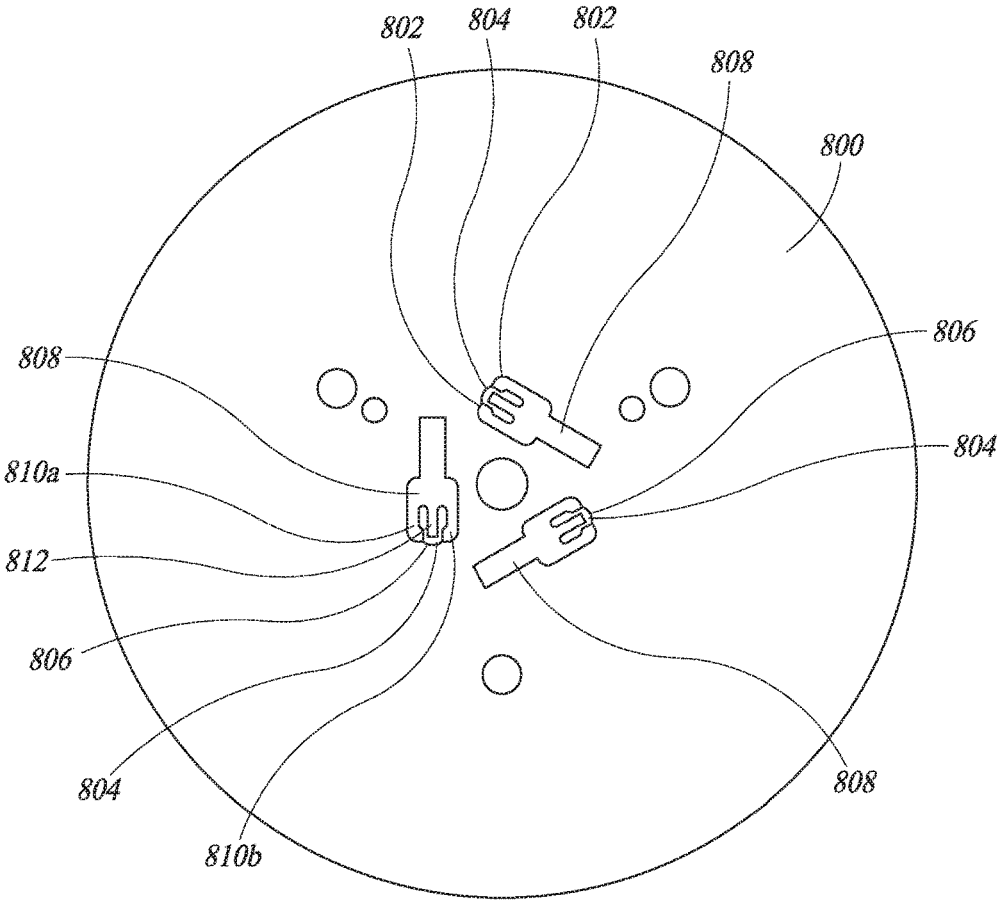
FIG. 8 is a top plan view of a primary PCB that includes alternative flexible portions and respective PCB electrical connectors, according to at least one illustrated implementation.

FIG. 8 shows a PCB 800 that includes alternative flexible portions 802 and respective PCB electrical connectors 804, according to at least one illustrated implementation. The PCB electrical connectors 804 may be formed directly onto the PCB 800, including the edge of the flexible portions 802. Such PCB electrical connectors 804 may include two opposing portions 810*a*, 810*b* separated by a channel 812. The channel 812 may be sized and positioned to engage with a respective one of the male electrical contacts 702 from the twist-lock plug 700 when the male electrical contact 702 is inserted into and rotatably engaged with a corresponding one of the female electrical receptacles 128 in the mounting base 110. When engaged, each male electrical contact 702 may be positioned within a corresponding one of the channels 812 of the PCB electrical connectors 804 in which the male electrical contact 702 physically engages and deflects (e.g., pushes apart) the two opposing portions 810*a*, 810*b*. Routed areas 808 in the PCB 800 proximate the PCB electrical connectors 804 may provide clearance for the male electrical contacts from the twist-lock plug 700 to be inserted and then twisted to be physically and electrically coupled to the PCB electrical connectors 804. In such an implementation, the PCB electrical connectors 804 may be electrically coupled to other electrical components on the PCB 800 via PCB traces 806 in the PCB 800.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one implementation, the present subject matter may be implemented via Application Specific Integrated Circuits (ASICs). However, those skilled in the art will recognize that the implementations disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

Those of skill in the art will recognize that many of the methods or algorithms set out herein may employ additional acts, may omit some acts, and/or may execute acts in a different order than specified.

In addition, those skilled in the art will appreciate that the mechanisms taught herein are capable of being distributed as a program product in a variety of forms, and that an illustrative implementation applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

The various implementations described above can be combined to provide further implementations. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 61/052,924, filed May 13, 2008; U.S. Pat. No. 8,926,138, issued Jan. 6, 2015; PCT Publication No. WO2009/140141, published Nov. 19, 2009; U.S. Provisional Patent Application No. 61/051,619, filed May 8, 2008; U.S. Pat. No. 8,118,456, issued Feb. 21, 2012; PCT Publication No. WO2009/137696, published Nov. 12, 2009; U.S. Provisional Patent Application No. 61/088,651, filed Aug. 13, 2008; U.S. Pat. No. 8,334,640, issued Dec. 18, 2012; U.S. Provisional Patent Application No. 61/115,438, filed Nov. 17, 2008; U.S. Provisional Patent Application No. 61/154,619, filed Feb. 23, 2009; U.S. Patent Publication No. 2010/0123403, published May 20, 2010; U.S. Patent Publication No. 2016/0021713, published Jan. 21, 2016; PCT Publication No. WO2010/057115, published May 20, 2010; U.S. Provisional Patent Application No. 61/174,913, filed May 1, 2009; U.S. Pat. No. 8,926,139, issued Jan. 6, 2015; PCT Publication No. WO2010/127138, published Nov. 4, 2010; U.S. Provisional Patent Application No. 61/180,017, filed May 20, 2009; U.S. Pat. No. 8,872,964, issued Oct. 28, 2014; U.S. Patent Publication No. 2015/0015716, published Jan. 15, 2015; PCT Publication No. WO2010/135575, published Nov. 25, 2010; U.S. Provisional Patent Application No. 61/229,435, filed Jul. 29, 2009; U.S. Patent Publication No. 2011/0026264, published Feb. 3, 2011; U.S. Provisional Patent Application No. 61/295,519, filed Jan. 15, 2010; U.S. Provisional Patent Application No. 61/406,490, filed Oct. 25, 2010; U.S. Pat. No. 8,378,563, issued Feb. 19, 2013; PCT Publication No. WO2011/088363, published Jul. 21, 2011; U.S. Provisional Patent Application No. 61/333,983, filed May 12, 2010; U.S. Pat. No. 8,541,950, issued Sep. 24, 2013; PCT Publication No. WO2010/135577, published Nov. 25, 2010; U.S. Provisional Patent Application No. 61/346,263, filed May 19, 2010; U.S. Pat. No. 8,508,137, issued Aug. 13, 2013; U.S. Pat. No. 8,810,138, issued Aug. 19, 2014; U.S. Pat. No. 8,987,992, issued Mar. 24, 2015; PCT Publication No. WO2010/135582, published Nov. 25, 2010; U.S. Provisional Patent Application No. 61/357,421, filed Jun. 22, 2010; U.S. Pat. No. 9,241,401, granted Jan. 19, 2016; PCT Publication No. WO2011/163334, published Dec. 29, 2011; U.S. Pat. No. 8,901,825, issued Dec. 2, 2014; U.S. Patent Publication No. 2015/0084520, published Mar. 26, 2015; PCT Publication No. WO2012/142115, published Oct. 18, 2012; U.S. Pat. No. 8,610,358, issued Dec. 17, 2013; U.S. Provisional Patent Application No. 61/527,029, filed Aug. 24, 2011; U.S. Pat. No. 8,629,621, issued Jan. 14, 2014; PCT Publication No. WO2013/028834, published Feb. 28, 2013; U.S. Provisional Patent Application No. 61/534,722, filed Sep. 14, 2011; U.S. Pat. No. 9,312,451, issued Apr. 12, 2016; PCT Publication No. WO2013/040333, published Mar. 21, 2013; U.S. Provisional Patent Application No. 61/567,308, filed Dec. 6, 2011; U.S. Pat. No. 9,360,198, issued Jun. 7, 2016; U.S. Provisional Patent Application No. 61/561,616, filed Nov. 18, 2011; U.S. Patent Publication No. 2013/0141010, published Jun. 6, 2013; PCT Publication No. WO2013/074900, published May 23, 2013; U.S. Provisional Patent Application No. 61/641,781, filed May 2, 2012; U.S. Patent Publication No. 2013/0293112, published Nov. 7, 2013; U.S. Patent Publication No. 2013/0229518, published Sep. 5, 2013; U.S. Provisional Patent Application No. 61/640,963, filed May 1, 2012; U.S. Patent Publication No. 2013/0313982, published Nov. 28, 2013; U.S. Patent Publication No. 2014/0028198, published Jan. 30, 2014; U.S. Pat. No. 9,801,248, issued Oct. 24, 2017; PCT Publication No. WO2014/018773, published Jan. 30, 2014; U.S. Provisional Patent Application No. 61/723,675, filed Nov. 7, 2012; U.S. Pat. No. 9,301,365, issued Mar. 29, 2016; U.S. Provisional Patent Application No. 61/692,619, filed Aug. 23, 2012; U.S. Patent Publication No. 2014/0055990, published Feb. 27, 2014; U.S. Provisional Patent Application No. 61/694,159, filed Aug. 28, 2012; U.S. Pat. No. 8,878,440, issued Nov. 4, 2014; U.S. Patent Publication No. 2014/0062341, published Mar. 6, 2014; U.S. Patent Publication No. 2015/0077019, published Mar. 19, 2015; PCT Publication No. WO2014/039683, published Mar. 13, 2014; U.S. Provisional Patent Application No. 61/728,150, filed Nov. 19, 2012; U.S. Patent Publication No. 2014/0139116, published May 22, 2014; U.S. Pat. No. 9,433,062, issued Aug. 30, 2016; PCT Publication No. WO2014/078854, published May 22, 2014; U.S. Provisional Patent Application No. 61/764,395, filed Feb. 13, 2013; U.S. Pat. No. 9,288,873, issued Mar. 15, 2016; U.S. Provisional Patent Application No. 61/849,841, filed Jul. 24, 2013; U.S. Patent Publication No. 2015/0028693, published Jan. 29, 2015; PCT Publication No. WO2015/013437, published Jan. 29, 2015; U.S. Provisional Patent Application No. 61/878,425, filed Sep. 16, 2013; U.S. Patent Publication No. 2015/0078005, published Mar. 19, 2015; PCT Publication No. WO2015/039120, published Mar. 19, 2015; U.S. Provisional Patent Application No. 61/933,733, filed Jan. 30, 2014; U.S. Pat. No. 9,185,777, issued Nov. 10, 2015; PCT Publication No. WO2015/116812, published Aug. 6, 2015; U.S. Provisional Patent Application No. 61/905,699, filed Nov. 18, 2013; U.S. Pat. No. 9,414,449, issued Aug. 9, 2016; U.S. Pat. No. 9,781,797, issued Oct. 3, 2017; U.S. Provisional Patent Application No. 62/068,517, filed Oct. 24, 2014; U.S. Provisional Patent Application No. 62/183,505, filed Jun. 23, 2015; U.S. Pat. No. 9,445,485, issued Sep. 13, 2016; PCT Publication No. WO2016/064542, published Apr. 28, 2016; U.S. Provisional Patent Application No. 62/082,463, filed Nov. 20, 2014; U.S. Publication No. 2016/0150369, published May 26, 2016; PCT Publication No. WO2016/081071, published May 26, 2016; U.S. Provisional Patent Application No. 62/057,419, filed Sep. 30, 2014; U.S. Publication No. 2016/0095186, published Mar. 31, 2016; PCT Publication No. WO2016/054085, published Apr. 7, 2016; U.S. Provisional Patent Application No. 62/114,826, filed Feb. 11, 2015; U.S. Non-provisional patent application Ser. No. 14/939,856, filed Nov. 12, 2015; U.S. Provisional Patent Application No. 62/137,666, filed Mar. 24, 2015; U.S. Non-provisional patent application Ser. No. 14/994,569, filed Jan. 13, 2016; U.S. Non-provisional patent application Ser. No. 14/844,944, filed Sep. 3, 2015; U.S. Provisional Patent Application No. 62/208,403, filed Aug. 21, 2015; U.S. Non-provisional patent application Ser. No. 15/238,129, filed Aug. 16, 2016; U.S. Provisional Patent Application No. 62/264,694, filed Dec. 8, 2015; U.S. Non-provisional patent application Ser. No. 15/369,559, filed Dec. 5, 2016; U.S. Provisional Patent Application No. 62/397,709, filed Sep. 21, 2016; U.S. Non-provisional patent application Ser. No. 15/709,022, filed Sep. 19, 2017; U.S. Provisional Patent Application No. 62/397,713, filed Sep. 21, 2016; U.S. Non-provisional patent application Ser. No. 15/709,028, filed Sep. 19, 2017; U.S. Provisional Patent Application No. 62/327,939, filed Apr. 26, 2016; U.S. Non-provisional patent application Ser. No. 15/496,985, filed Apr. 25, 2017; U.S. Provisional Patent Application No. 62/379,037, filed Aug. 24, 2016; U.S. Non-provisional patent application Ser. No. 15/681,927, filed Aug. 21, 2017; U.S. Provisional Patent Application No. 62/458,970, filed Feb. 14, 2017; U.S. Provisional Patent Application No. 62/480,833, filed Apr. 3, 2017; U.S. Provisional Patent Application No. 62/507,730, filed May 17, 2017; are incorporated herein by reference, in their entirety. Aspects of the implementations can be modified, if necessary, to employ systems, circuits and concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A twist-lock connector that receives a set of male electrical contacts, the twist-lock connector comprising:

a set of female electrical receptacles that correspond to the set of male electrical contacts, the set of female electrical receptacles sized and dimensioned to receive the set of male electrical contacts, and the set of female electrical receptacles are physically engageable with the set of male electrical contacts when each of the male electrical contacts in the set of male electrical contacts are inserted into respective ones of the female electrical receptacles in the set of female electrical receptacles and rotated;

a primary printed circuit board that has a first face and an opposing second face, the first face directed towards the female electrical receptacles; and a set of electrical connectors that correspond to the set of male electrical contacts, each of the electrical connectors positioned on respective ones of a set of flexible portions of the primary printed circuit board, each of the flexible portions resiliently deform responsive to one of the male electrical contacts contacting and exerting a force on the electrical connector positioned on the flexible portion to provide a biasing force that urges the electrical connector toward the male electrical contact.

2. The twist-lock connector of claim 1 wherein the set of female electrical receptacles includes three female electrical receptacles arranged around a central point.

3. The twist-lock connector of claim 1 wherein the set of electrical connectors are comprised of brass plated with tin.

4. The twist-lock connector of claim 1 wherein each of the flexible portions of the primary circuit board is separated from remaining parts of the primary circuit board on a plurality of sides.

5. The twist-lock connector of claim 1 wherein each flexible portion comprises a proximal end and a distal end, the proximal end attached to the remaining part of the primary circuit board and the distal end separated therefrom.

6. The twist-lock connector of claim 5 wherein, for each of the flexible portions, the electrical connector is located proximate the distal end.

7. The twist-lock connector of claim 1 wherein the primary circuit board is comprised of a composite mat that has a matrix, wherein the primary circuit board includes a pattern of elements, and wherein the pattern of elements is rotated by a defined amount relative to the matrix of the composite mat.

8. The twist-lock connector of claim 7 wherein the matrix includes a first axis and a second axis, wherein each flexible portion extends in a direction from a proximal end to a distal end, and wherein the pattern of elements on the primary printed circuit board is rotated relative to the matrix of the composite mat such that the respective direction in which each flexible portion extends is parallel to at least one of the first axis and the second axis of the matrix.

9. The twist-lock connector of claim 1, further comprising:

a secondary circuit board located on an opposite side of the female receptacles from the primary circuit board, the secondary circuit board includes a plurality of electrical connector pads arranged around a central axis.

10. The twist-lock connector of claim 9 wherein at least a subset of the plurality of electrical connector pads provides dimming control for an electrically coupled luminaire.

11. The twist-lock connector of claim 9, further comprising:

a support base that is clamped next to the second face of the primary printed circuit board and limits deflection of the flexible portions away from the female electrical receptacles.

12. The twist-lock connector of claim 11, further comprising:

a mounting base that includes the set of female receptacles, the mounting base located opposite the support base across the primary printed circuit board.

13. The twist-lock connector of claim 12, further comprising:

a screw that is threaded through and operable to clamp the support base, the primary printed circuit board, and the mounting base, wherein the mounting base is rotatable relative to the screw.

14. The twist-lock connector of claim 13, further comprising:

a twist-lock plug, the twist-lock plug includes the set of male electrical contacts, wherein the twist-lock plug further includes a photo-control component, and the mounting base is rotatable to selectively position the photo-control component.

15. The twist-lock connector of claim 11 wherein the flexible portions transition to a deformed position when the set of male electrical contacts are rotatably engaged with the set of female electrical receptacles.

16. The twist-lock connector of claim 1 wherein the electrical connectors are comprised of one or more opposing portions of the primary printed circuit board separated by a channel, wherein the channel is sized and positioned to engage with a respective one of the male electrical contacts when the male electrical contact is rotatably engaged with a corresponding one of the female electrical receptacles.

17. The twist-lock connector of claim 1 wherein each of the respective flexible portions is comprised of an internal tab that includes a fixed end and a free end.

18. The twist-lock connector of claim 1 wherein at least one of the electrical connectors is comprised of an electrical post.

19. The twist-lock connector of claim 18, wherein the electrical post include a proximal end and an opposing distal end, wherein the proximal end is located relatively closer to the primary circuit board and the distal end is located relatively away from the primary circuit board, and wherein the distal end includes a chamfer or tapered portion at an end that is directed away from the primary circuit board.

20. A method of physically coupling a twist-lock connector with a twist-lock plug, the twist-lock plug including a plurality of male electrical contacts, the twist-lock connector including a plurality of female electrical receptacles and a primary printed circuit board that includes a set of flexible portions, such flexible portions including an electrical contact and aligning with respective ones of the female electrical receptacles, the method comprising:

inserting each of the male electrical contacts of the twist-lock plug into respective ones of the female electrical receptacles, the female electrical receptacles guide the male electrical contacts towards the electrical contacts on respective ones of the flexible portions;

twisting the twist-lock plug with respect to the twist-lock connector, such twisting which securely engages the male electrical contacts with the respective ones of the female electrical receptacles; and deforming at least one of the flexible portions by the male electrical contacts into a deformed position responsive to one of the male electrical contacts contacting and exerting a force on the electrical contact positioned on the flexible portion.

21. The method of claim 20 wherein deforming at least one of the flexible portions comprises deforming at least one of the flexible portions in which the at least one flexible portion is separated from remaining parts of the primary circuit board on a plurality of sides.

22. The method of claim 20 wherein deforming at least one of the flexible portions comprises deforming the at least one of the flexible portions in the primary printed circuit board, wherein the at least one of the flexible portions comprises a proximal end and a distal end, the proximal end attached to the remaining part of the primary circuit board and the distal end separated therefrom.

23. The method of claim 22 wherein the primary circuit board is comprised of a composite mat that has a matrix that includes a first axis and a second axis, and wherein deforming at least one of the flexible portions comprises deforming the at least one of the flexible portions of the primary printed circuit board, wherein the primary circuit board includes a pattern of elements, and wherein the pattern of elements is rotated by a defined amount relative to the matrix of the composite mat.

24. The method of claim 20, further comprising:

clamping a support base next to the primary printed circuit board, the support base which limits deflection of the flexible portions away the female electrical receptacles.

25. The method of claim 24, further comprising:

clamping a mounting base to the primary printed circuit board, the mounting base which includes the plurality of female receptacles, the mounting base which is located opposite the support base across the primary printed circuit board.

26. The method of claim 20 wherein the electrical contacts are comprised of one or more portions of the primary printed circuit board separated by a channel, further comprising:

engaging respective ones of the male electrical contacts within corresponding channels when the male electrical contact is rotatably engaged with a corresponding one of the female electrical receptacles.

27. A method of manufacturing a twist lock connector that includes a mounting base, a support base, and a primary printed circuit board, the mounting base which includes at least one female electrical receptacle, the method comprising:

routing one or more portions of the primary printed circuit board to form one or more cut out sections, each cut out section surrounding a respective flexible portion of the primary printed circuit board in which each respective flexible portion resiliently deforms responsive to a force being applied to the flexible portion;

mounting the primary printed circuit board between the mounting base and the support base; and clamping the mounting base, the primary printed circuit board, and the support base such that each of the at least one female electrical receptacles is aligned with respective ones of the flexible portions of the primary printed circuit board.

28. The method of claim 27 wherein routing one or more portions of the primary printed circuit board to form one or more cut out sections includes routing at least three portions of the primary printed circuit board to form at least three flexible portions of the primary printed circuit board.

29. The method of claim 27, further comprising:

electrically coupling a set of electrical connectors to the primary printed circuit board, at least one electrical connector in the set of electrical connectors being electrically coupled to one of the flexible portions of the primary printed circuit board, wherein at least one of the electrical connectors in the set of electrical connectors is comprised of brass plated with tin.

30. The method of claim 27, wherein the primary printed circuit board is comprised of a composite mat that has a matrix that includes a first axis and a second axis and wherein the primary printed circuit board includes a pattern of elements, the method further comprising:

rotating the pattern of elements in the primary printed circuit board a defined amount relative to the matrix of the composite mat.

31. The method of claim 30 wherein the matrix includes a first axis and a second axis, wherein each flexible portion extends in a direction from a proximal end to a distal end, and wherein rotating the pattern of elements on the primary printed circuit board includes rotating the pattern of elements on the primary printed circuit board such that the respective direction in which each flexible portion extends is parallel to at least one of the first axis and the second axis of the matrix.

32. The method of claim 27 wherein clamping the mounting base, the primary printed circuit board, and the support base further includes clamping the support base and the primary printed circuit board to thereby limit an amount of deflection of the flexible portions of the primary printed circuit board away from the female electrical receptacles in response to the force being applied to the flexible portions.

* * * * *